US005363816A

United States Patent [19]

Yorita et al.

[11] Patent Number: 5,363,816

[45] Date of Patent: Nov. 15, 1994

[54] VALVE DRIVE DEVICE

[75] Inventors: Hiroshi Yorita, Kariya; Toshihiko Igashira, Toyokawa; Yasuyuki Sakakibara, Nishio; Moriyasu Gotoh; Kazuhide Watanabe, both of Toyohashi, all of Japan

[73] Assignee: Nippon Soken, Inc., Nishio, Japan

[21] Appl. No.: 184,060

[22] Filed: Jan. 21, 1994

[30] Foreign Application Priority Data

Jan. 21, 1993 [JP] Japan ..... 5-008286
Apr. 2, 1993 [JP] Japan ..... 5-076969

[51] Int. Cl.[5] ..... F01L 9/02

[52] U.S. Cl. ..... 123/90.12; 123/90.13; 123/90.15

[58] Field of Search ..... 123/90.12, 90.13, 90.15, 123/90.16

[56] References Cited

U.S. PATENT DOCUMENTS 3,361,121 1/1968 Schott ..... 123/90.13
4,174,687 11/1979 Fuhrmann ..... 123/90.13
4,821,689 4/1989 Tittizer et al. ..... 123/90.12
4,898,129 2/1990 Junghans ..... 123/90.13
5,197,419 3/1993 Dingess ..... 123/90.13
5,209,453 5/1993 Aota et al. ..... 123/90.13

FOREIGN PATENT DOCUMENTS 3909822 9/1990 Germany .

*Primary Examiner*—E. Rollins Cross
*Assistant Examiner*—Weilun Lo
*Attorney, Agent, or Firm*—Cushman, Darby & Cushman

[57] ABSTRACT

A hydraulic valve drive device for intake/exhaust valves of an internal combustion engine using an oil pump similar to a distributor type injection pump. A plunger rotates and engages in reciprocating motion to pressurize hydraulic fluid taken into a pressure chamber and opens to discharge the same into a hydraulic cylinder of a specific intake/exhaust valve in register with the passage. The intake/exhaust valve maintains its valve lift to continue remaining open when the supply of the hydraulic fluid is stopped, but closes when the plunger rotates so that the passage is communicated with a relief channel and the relief valve opens.

12 Claims, 19 Drawing Sheets

VALVE DRIVE DEVICE

BACKGROUND OF THE INVENTION

1. Field of the Invention

The present invention relates to a drive device for intake/exhaust valves (intake valves and/or exhaust valves) used in an internal combustion engine, more particularly relates to a valve drive device having a mechanism for changing the valve timing which enables free adjustment of the valve timing using hydraulic pressure.

2. Description of the Related Art

In a drive device of intake/exhaust valves of an internal combustion engine, there has been known a mechanism for changing the valve timing which is inserted into the connection portion between a timing pulley driven by a crankshaft and a camshaft and changes the phase of the camshaft with respect to the timing pulley by a cam mechanism controlled by hydraulic pressure or one, such as disclosed in the specification of German Patent No. 3909822, which does not use a camshaft for mechanically driving the intake/exhaust valves, but uses a high pressure oil pump having substantially the same construction as an in-line fuel injection pump for diesel engines to control and supply hydraulic pressure to hydraulic cylinders attached to the intake/exhaust valves and uses that hydraulic pressure to directly drive the operation of the intake/exhaust valves.

In the former related art, the only thing which could be changed by the valve timing changing mechanism was the phase of the camshaft with respect to the timing pulley, so there was the defect of a relatively low degree of freedom in control. In the latter, while the degree of freedom in control was relatively high, it was necessary to install a relatively large sized oil pump having the same number of cylinders as the number of cylinders of the engine, like with an in-line fuel injection pump, which made the construction of the related equipment complicated and was disadvantageous in the space and cost required.

As one means of solving the problems in the latter related art, consideration may be given to the use of a distributor type oil pump of a structure similar to a distributor type injection pump even in a hydraulic system for driving the intake/exhaust valves learning from the fact that a distributor type injection pump is used instead of an in-light fuel injection pump in relatively small-sized diesel engines.

In this case, however, the intake/exhaust valves of all of the cylinders of the engine are operated in succession by a single distributor type oil pump, which rotates at a speed half of the crankshaft of the engine, so in a four-cycle engine with four cylinders, for example, the time for opening the intake valve or exhaust valve of a single cylinder is even at the maximum 180° in terms of the rotational angle of the engine crankshaft and cannot exceed 90° in terms of the rotational angle of the oil pump. Of course, in an engine with a greater number of cylinders such as six cylinders or eight cylinders, the time for opening the intake/exhaust valve becomes much shorter. However, the time for opening the intake/exhaust valve of an internal combustion engine in general has to be about 220° to 240° in terms of the engine rotational angle (110° to 120° in terms of the rotational angle of the oil pump), so in this case it is not possible to secure the valve opening time required for an intake/exhaust valve and sufficient practicality for an internal combustion engine cannot be obtained.

SUMMARY OF THE INVENTION

The object of the present invention is to solve these problems in the related art. More specifically, the present invention has as its object the provision of a novel hydraulic valve drive device which is relatively small in size, low in cost, and high in freedom of control and can give a sufficiently long opening time for an intake/exhaust valve of an internal combustion engine without causing problems such as mentioned earlier even when using an oil pump having a construction similar to a distributor type injection pump.

The present invention, as a basic means for solving the problems, provides a valve drive device provided with a plunger which is driven to rotate by the internal combustion engine and moves reciprocatingly in the axial direction of rotation as well, a cylinder which is formed in a cylinder block and receives the plunger fluid-tightly, at least one low pressure side chamber which can store hydraulic fluid in it, a pressure chamber (pressurizing chamber) which is formed in the cylinder block at the end of the plunger, takes in the hydraulic fluid of the low pressure side chamber and pressurizes the same, a discharge passage which is formed in the plunger and communicates with the pressure chamber and has at least one opening at a columnar surface of the plunger, a discharge port which is formed in the cylinder block so as to receive the hydraulic fluid pressurized in the pressure chamber when placed in register with the opening of the discharge passage by the rotational drive of the plunger, a valve driving hydraulic cylinder connected to the discharge port through a high pressure passage, a hydraulic piston which is inserted fluid-tightly in the hydraulic cylinder and generates a force for opening an intake/exhaust valve of the internal combustion engine when receiving pressurized hydraulic fluid from the high pressure passage, at least one relief channel which is formed in the plunger and is able to communicate the high pressure passage to the low pressure side chamber by having at least one opening in the columnar surface of the plunger so as to discharge the pressurized hydraulic fluid in the high pressure passage to the low pressure side chamber and closes the intake/exhaust valve, at least one relief port which is formed in the cylinder block and opens to a position able to communicate with the opening of the relief channel by rotational motion of the plunger, and a pressure reduction mechanism which is inserted between the relief port and the low pressure side chamber and controls the timing of closing of the intake/exhaust valve.

In the valve drive device of the present invention, by making the plunger rotate driven by the internal combustion engine and at the same time engage in reciprocating motion in the axial direction, the hydraulic fluid taken in from the low pressure side chamber to the pressure chamber is pressurized and discharged to the discharge port in the cylinder block in register with the discharge passage. It is supplied through the high pressure passage to the hydraulic cylinder to push down the hydraulic piston, thereby opening the intake/exhaust valve. When the additional supply of the hydraulic fluid to the hydraulic cylinder is stopped, the intake/exhaust valve maintains the valve lift at that time and continues in the open state. When the plunger rotates and the high pressure passage communicates with the relief channel and the pressure reduction mechanism operates at a predetermined valve closing timing so that the relief channel communicates with at least one relief port and in that state the relief valve opens, the pressure of the hydraulic fluid of the hydraulic cylinder falls and the intake/exhaust valve closes.

According to the present invention, not only is it possible to give a sufficiently long opening time to an intake/exhaust valve of the internal combustion engine, but also it is possible to obtain a hydraulic valve drive device which has a high degree of freedom of control, is relatively small in size and low in cost, and is high in safety.

Other objects and effects of the present invention will become clearer from the following detailed description with reference to the appended drawings.

BRIEF DESCRIPTION OF THE DRAWINGS

In the appended drawings.

DESCRIPTION OF THE PREFERRED EMBODIMENTS

Figure 1:
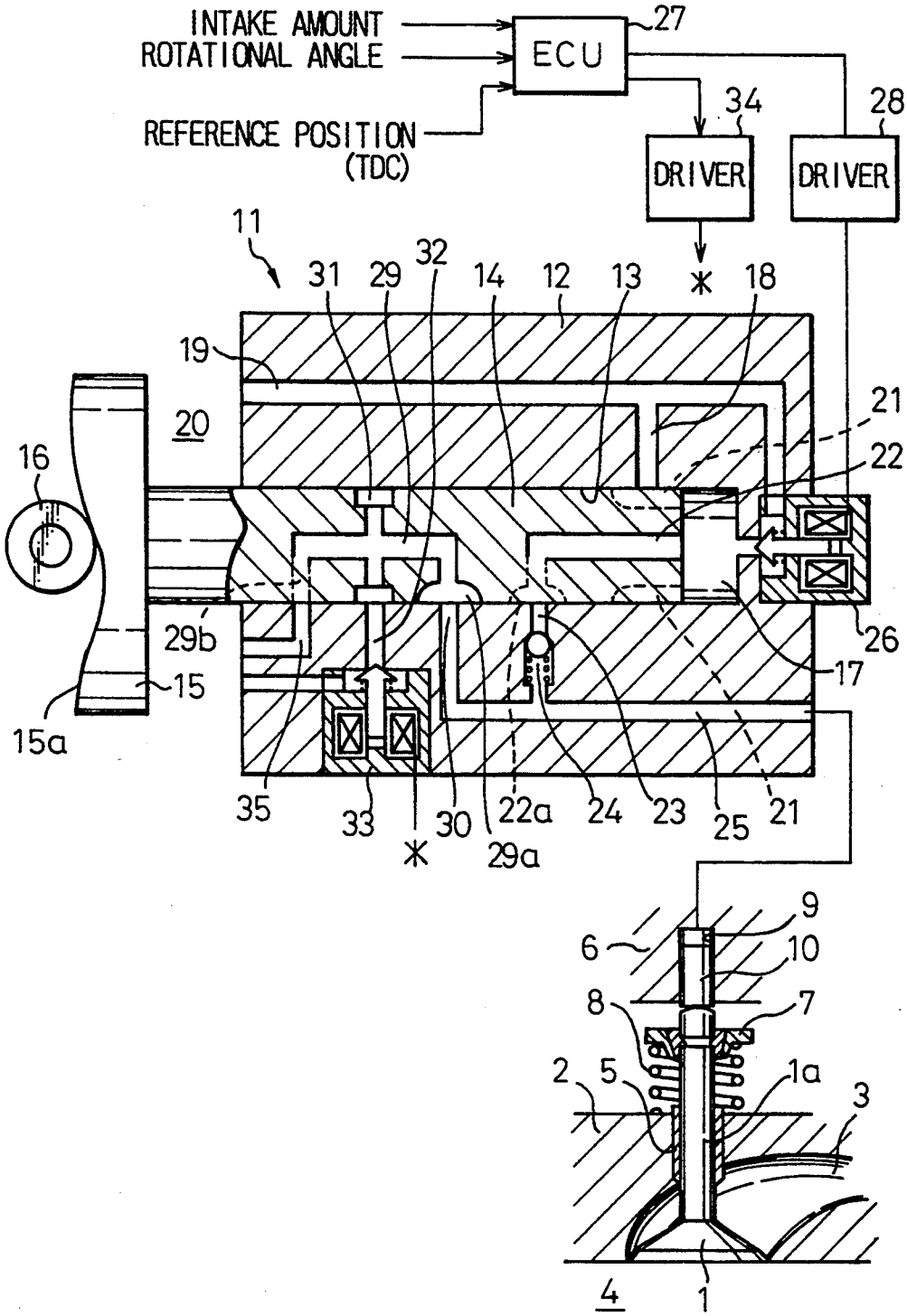
FIG. 1 is a sectional view of the overall configuration of a valve drive device according to a first embodiment of the present invention.

FIG. 1 shows the overall configuration of a valve drive device according to a first embodiment of the present invention. In the same way as the known art, an intake valve or exhaust valve (abbreviated as an intake/exhaust valve) 1 is provided so as to open or close the space between a port 3 at the end of an intake passage or exhaust passage of a cylinder head 2 of an engine and a combustion chamber 4. A stem 1*a* passes through a valve guide 5 and projects out into the space formed by a not shown head cover 6. At the stem 1*a* is mounted a retainer 7, between which retainer 7 and the cylinder head 2 is inserted a compression spring, that is, a valve spring 8, which biases the intake/exhaust valve 1 at all times toward the valve closing position.

At the head cover 6 are formed hydraulic cylinders 9 corresponding to each of the intake/exhaust valves 1. In each hydraulic cylinder 9 is inserted a hydraulic piston 10 in a fluid-tight manner. One end abuts against the front end of the stem 1*a* of the intake/exhaust valve 1. The above construction is substantially the same as the construction of a conventional hydraulic valve drive device.

To drive an intake/exhaust valve 1 to open and close through the hydraulic piston 10, in the present invention provision is made of a distributor type oil pump 11. The construction of the oil pump 11 resembles the construction of the well known distributor type injection pump used for compact diesel engines. That is, the distributor type oil pump 11 has a single pump cylinder 13 which pierces through the cylinder block 12 and has inserted within it a single plunger 14 in a fluid-tight manner. The plunger 14 has integrally attached to it a circular face cam 15. A wave-like cam face 15*a* formed at the peripheral edge of the left face of the face cam 15 is biased by a compression spring, not shown, and thereby contacts a cam roller 16 placed at predetermined position.

The plunger 14 is connected to a crankshaft of an engine by a transmission mechanism, not shown, and rotates at a rotational speed of one-half that of the crankshaft, but since the wave-like cam face 15*a* of the face cam 15 is pressed at all times against the cam roller 16 which is at a stationary position, the rotation causes a reciprocating motion in the axial direction of the plunger 14. The plunger 14 also ends up engaged in reciprocating motion in the axial direction at the same time while rotating in the pump cylinder 13. The reciprocating motion of the plunger 14 causes a repeated increase and reduction in the volume of a pressure chamber (pressurizing chamber) 17 formed inside the plump cylinder 13, so the pump action is controlled the pressure chamber 17. Further, the rotational motion of the plunger 14 enables the successive distribution of pressurized hydraulic fluid to the hydraulic cylinders 9 of the intake/exhaust valves 1 provided in the cylinder heads 2 of the cylinders of a multicylinder engine.

At the cylinder block 12 of the distributor type oil pump 11 is formed an intake port 18 which communicates with a "low pressure side chamber" through a low pressure passage 19, in this example, with a low pressure chamber 20 housing the face cam 15, cam roller 16, etc. In the low pressure chamber 20 is supplied a hydraulic fluid, stored in a hydraulic fluid tank, not shown, which is pressurized to a predetermined low pressure by a feed pump. This fills the space. Of course, in some cases, the hydraulic fluid tank and feed pump are not used, but hydraulic fluid of atmospheric pressure is stored in the low pressure chamber 20. In the plunger 14 in the axial direction of the same are formed intake grooves 21 of exactly the number of intake/exhaust valves 1 being controlled arranged at equidistant positions on its circumference. In the intake stroke of the oil pump 11 where the plunger 14 moves in the left direction, these are communicated with the intake port 18 successively due to the rotational motion and can take hydraulic fluid into the pressure chamber 17 from the low pressure chamber 20.

The plunger 14 has a discharge passage 22 formed in it, while the sliding face with the pump cylinder 13 has an enlarged opening 22*a* formed in it. At the inside surface of the pump cylinder 13 are opened a number of discharge ports 23, arranged equidistantly on the circumference, corresponding to the intake/exhaust valves 1 under control so as to enable communication with the opening 22*a* of the discharge passage 22 in accordance with the movement of the plunger 14 in the rotational direction and axial direction. For example, they are communicated with the high pressure passage 25 provided with respect to the intake/exhaust valve 1 through a check valve 24 comprised of steel balls and a spring biasing the same.

Part of the high pressure hydraulic fluid which is produced in the pressure chamber 17 by the motion of plunger 14 can be bypassed to the low pressure chamber 20 at any time to reduce the pressure of the hydraulic fluid supplied to the hydraulic cylinder 9 of an intake/exhaust valve 1 by the provision of a spill valve 26 between the pressure chamber 17 and the low pressure passage 19 communicating with the low pressure chamber 20. The spill valve 26 is a valve which can be electrically controlled, for example, a solenoid valve, and is controlled to operate through a driver (drive circuit) 28 by an electronic control unit (ECU) 27. For this purpose, the ECU 27 receives intake amount signals showing the engine load, rotational angle signals, reference position signals issued when the piston of a specific cylinder reaches top dead center as a reference position, etc., as inputs from various types of sensors provided at the air flow meter, distributor, etc. of the engine. A storage device of the same stores the optimal opening and closing timings of the intake/exhaust valves 1, the data of the relief valve, etc. The ECU 27 performs computations based on this data and outputs control signals to the driver 28 etc.

Corresponding to the biggest feature of the present invention, in the first embodiment shown in FIG. 1, a passage called a relief channel 29 is formed in the axial direction of the plunger 14. One end of this forms the single opening 29*a* in the sliding face with the pump cylinder 13. Along with the rotational motion of the plunger 14, the opening 29*a* is successively communicated with the first relief ports 30 which are provided at equidistant positions of the cylinder 13 in exactly the same number as the intake/exhaust valves 1 which are covered. The relief ports 30 are connected to the hydraulic cylinders 9 of the intake/exhaust valves 1 by the afore-mentioned high pressure passage 25.

The relief channel 29 is provided with a passage in the radial direction and communicates with an annular groove 31 wide in the axial direction and formed at the circumference of the plunger 14. A single second relief port 32 is formed at the cylinder block 12 at a position in constant communication with the annular groove 31. A relief valve 33 is provided between this and the low pressure chamber 20. The relief valve 33, like the spill valve 26, is a valve which can be electrically controlled, such as a solenoid valve, and is automatically controlled to open and close through a driver 34 by the ECU 27. In this case, a single relief valve 33 may be provided in common for all the hydraulic cylinders 9 of the intake/exhaust valves 1. When the relief valve 33 opens, the relief channel 29 is communicated with the low pressure chamber 20 and discharges into the low pressure chamber 20 the high pressure hydraulic fluid maintained in the hydraulic cylinder 9 communicated with the same through the one of the relief ports 30 which the opening 29*a* communicates with at that time and therefore can close the intake/exhaust valves 1 by the force of the valve spring 8.

Further, as another feature of the first embodiment, in the relief channel 29 of the plunger 14 is formed another opening 29*b* in the sliding surface with the pump cylinder 13 by the radial direction passage. So that the opening 29*b* can communicate with the low pressure chamber 20 when the plunger 14 reaches a predetermined rotational position and regardless of the opening or closing of the relief valve 33 can discharge into the low pressure chamber 20 the high pressure hydraulic fluid in the high pressure passage 25 and hydraulic cylinder 9 communicated with the relief channel 29 at that time, third relief ports 35 of the same number as the number of intake/exhaust valves being driven are formed in the cylinder block 12 and communicated at all times with the low pressure chamber 20.

Next, an explanation will be made of the operation of the valve drive device of the first embodiment shown in FIG. 1. When the plunger 14 is driven to rotate, it engages in reciprocating motion in the axial direction at the same time as well due to the engagement between the face cam 15 and the cam roller 16, so when an intake groove 21 comes into register with the intake port 18 of the low pressure passage 19 during the intake stroke, the low pressure hydraulic fluid in the low pressure chamber 20 is taken into the pressure chamber 17. When the plunger 14 enters the compression stroke, the hydraulic fluid in the pressure chamber 17 is compressed and the pressure rises, but while the ECU 27 keeps the spill valve 26 open through the driver 28, the hydraulic fluid in the pressure chamber 17 passes through the low pressure passage 19 and is discharged to the low pressure chamber 20, so the pressure of the hydraulic fluid does not rise and there is no action caused to open an intake/exhaust valve 1.

In the compression stroke of the pump cylinder 13, when the spill valve 26 is closed by the ECU 27, the hydraulic fluid in the pressure chamber 17 is pressurized and becomes high in pressure, but at this time if the opening 22*a* of the discharge passage 22 communicates with one of the discharge ports 23, the high pressure hydraulic fluid in the pressure chamber 17 enters from the discharge passage 22 to the discharge port 23, pushes open the check valve 24, is discharged to the high pressure passage 25, and is supplied to the hydraulic cylinder 9 to push down the hydraulic piston 10. By this, one intake/exhaust valve 1 is opened against the force of the valve spring 8.

In the process of opening of an intake/exhaust valve 1 in this manner, if the ECU 27 opens the spill valve 26, the pressure of the hydraulic fluid in the pressure chamber 17 will fall, so the check valve 24 will close and no greater lift will be given to the intake/exhaust valve 1.

Accordingly, the intake/exhaust valve 1 will maintain the given lift and remain in the open state. Due to this action, it is possible to give an open state of any degree of opening at any time to an intake/exhaust valve 1 and it is possible to maintain the open state. It goes without saying that once the valve opens, even if the plunger 14 rotates and the opening 22*a* of the discharge passage 22 communicates with the next discharge port 23, so that another intake/exhaust valve 1 is opened, the previous intake/exhaust valve 1 can maintain its open state with the lift given regardless of this.

Further, if the plunger 14 rotates and the opening 29*a* of the relief channel 29 comes into register with a relief port 30 of the high pressure passage 25 and the ECU 27 opens the relief valve 33, the high pressure hydraulic fluid in the high pressure passage 25 passes through the relief port 32 and is discharged into the low pressure chamber 20, so the pressure inside the hydraulic cylinder 9 falls and an intake/exhaust valve 1 is made to close by the valve spring 8. Therefore, the timing of closing of the intake/exhaust valve 1 can be controlled by the relief valve 33 regardless of the other intake/exhaust valves 1, the timing of the opening of the intake/exhaust valves 1 can be freely selected in the above way, and also the duration of the opening time can be freely controlled.

Even if the relief valve 33 or the driver 34 controlling the same break down and the valve cannot De opened, when the plunger 14 further rotates and the opening 29*b* of the relief channel 29 communicates with a relief port 35, the pressure of the high pressure passage 25 and the hydraulic cylinder 9 is discharged into the low pressure chamber 20 and as a result an intake/exhaust valve 1 is forcibly made to close. In this sense, the relief ports 35 and the opening 29*b* of the relief channel 29 form a safety device in the valve drive device of the first embodiment.

Figure 2:
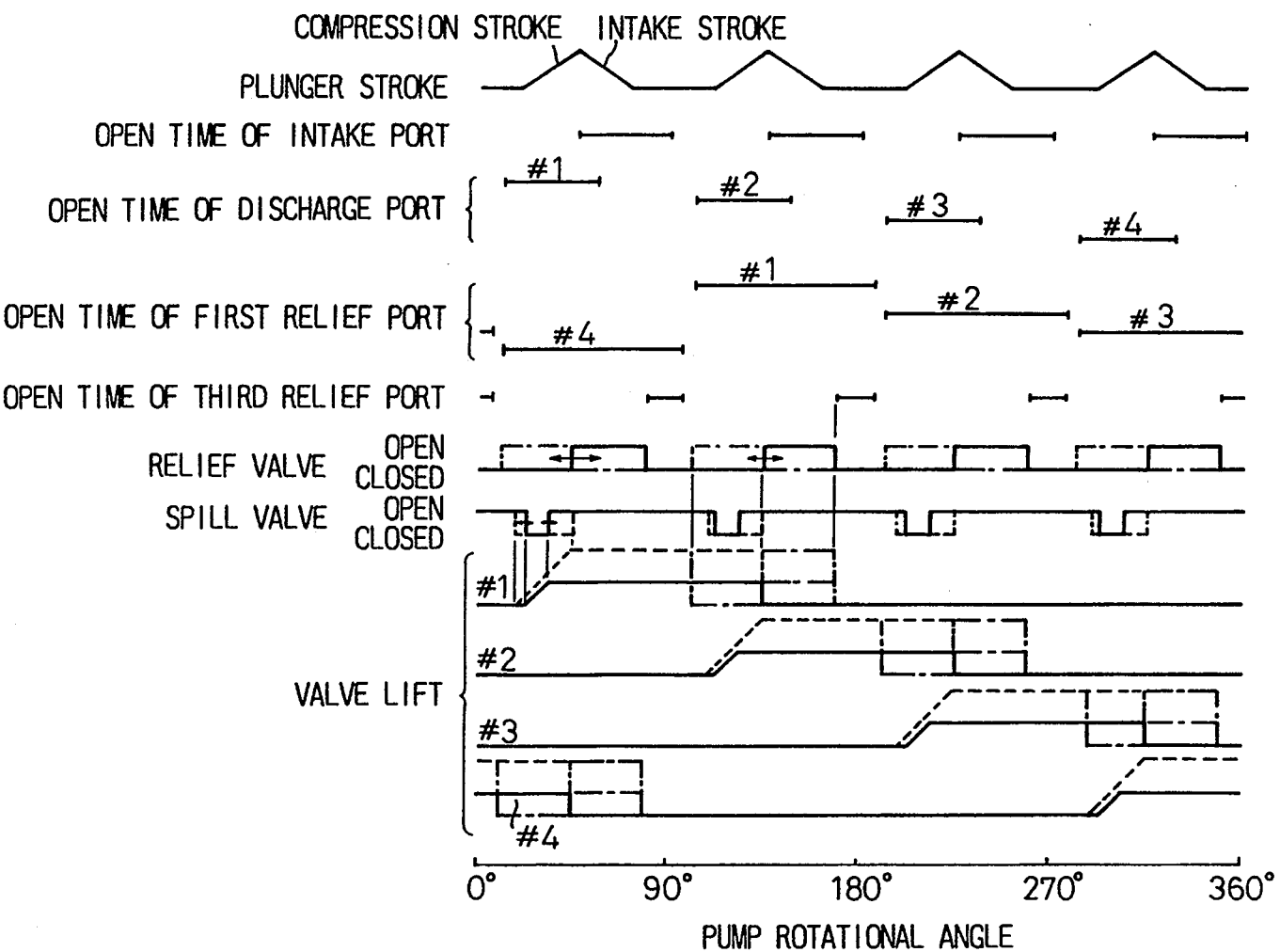
FIG. 2 is a time chart of the operation of the first embodiment.

The operation explained above is shown by way of a time chart in FIG. 2. As an example, the intake/exhaust valves 1 which are driven are made the four valves #1 to #4 and it is assumed that these successively opened for a predetermined period and then closed while the plunger 14 makes one turn. In FIG. 2, the common horizontal axis shows the rotational angle of the plunger 14 (pump rotational angle) showing the elapse of time and the vertical axes, from the top down, show the amount of movement of the plunger 14 in the axial direction (stroke), the opening time of the intake port when the intake port 18 and one of the intake grooves 21 are communicated, the opening time of the discharge port when the discharge passage 22 and one of the discharge ports 23 are communicated, the opening time of the first relief port when the opening 29*a* of the relief channel 29 is communicated with a first relief port 30, the opening time of the third relief port when the opening 29*b* of the relief channel 29 is communicated with a third relief port 35, the opening time in the case of the relief valve 33 changing its opening timing under command of the ECU 27, the opening time in the case of the spill valve 26 similarly changing the opening timing and closing timing under command of the ECU 27, and the valve lift resulting from these, which includes the changes in the opening timing, closing timing, opening time, degree of opening, etc. of the intake/exhaust valves 1 as against time.

As explained earlier and as clear from FIG. 2, by changing the opening timing of the relief valve 33 by the ECU 27 from for example the one-dot-chain line to the solid line, it is possible to freely change the closing timing of the intake/exhaust valves 1.

Further, by changing the closing time of the spill valve 26 in the compression stroke of the plunger 14 by the ECU 27 from for example the broken line to the solid line, it is possible to change the amount of the high pressure hydraulic fluid sent to the hydraulic cylinder 9 and freely change the amount of lift of the intake/exhaust valves 1 during opening. Similarly, it is possible to freely change the opening timing of the intake/exhaust valves 1 by changing the closing timing of the spill valve 26. Note that in FIG. 2, the valve lift of the intake/exhaust valves 1 shown by the broken line shows by way of example the case where the opening timing is made as early as possible and the lift is made maximum.

Note that the opening operation of the intake/exhaust valves 1 can be performed only in the compression stroke where the plunger 14 moves to the right in FIG. 1, but the closing operation of the intake/exhaust valves 1 is performed in the first embodiment by providing a relief channel 29 in the plunger 14 and discharging the pressure of the high pressure passage 25 by the first relief ports 30 and the relief valve 33 and so the closing timing can be selected substantially without regard to the position of the plunger 14 in the axial direction. Accordingly, by suitably selecting the opening positions of the relief ports 30 and 35 and the shape of the relief channel 29, it becomes possible to take as the opening time of the intake/exhaust valves 1 a maximum magnitude close to one rotation of the internal combustion engine (half rotation of the plunger 14), so even with an engine with a large number of cylinders, there is no need for reducing the opening time of the intake/exhaust valves 1 and it is possible to give a sufficiently long opening time to the intake/exhaust valves 1. Further, by providing the third relief ports 35, it is possible for the intake/exhaust valve 1 to close even in the unlikely event that the relief valve 33 should break down.

Figure 3:
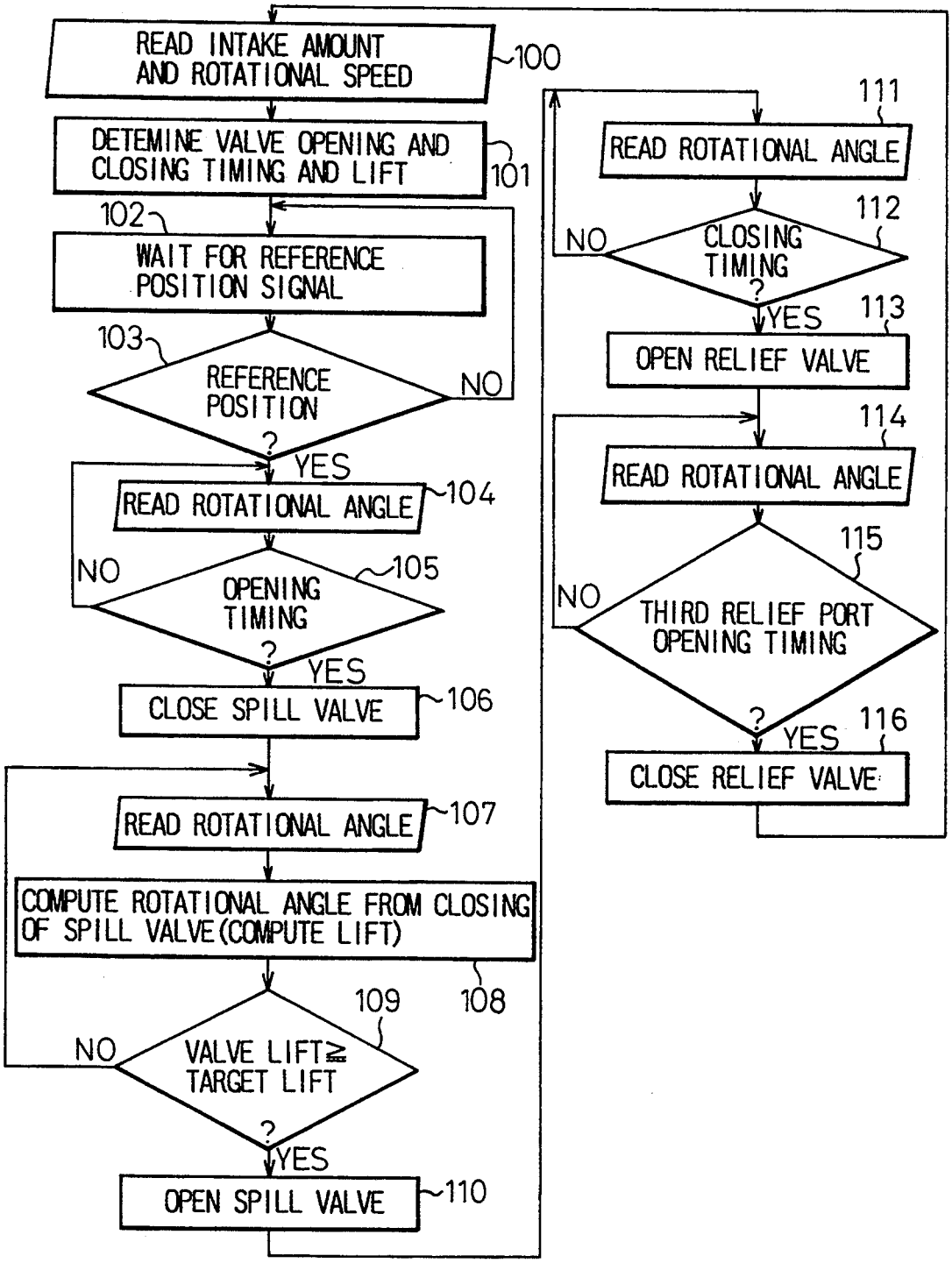
FIG. 3 is a flow chart of the control routine of the control device in the first embodiment.

FIG. 3 illustrates the control program in the case of controlling the opening and closing of the spill valve 26 and relief valve 33 by an ECU 27 housing a microprocessor. This program is executed by the microprocessor of the ECU 27 continuously while the internal combustion engine is running. The program starts simultaneously with the startup of the engine. At step 100, the signals of the intake amount and the engine rotational speed showing the magnitude of the engine load are read into the microprocessor of the ECU 27. At step 101, a map stored in a storage device is referred to, whereby the timing of opening and closing of the intake/exhaust valve 1 and the targeted size of the lift are determined. At step 102, a reference position signal is read from a sensor provided at the distributor. At step 103, it is judged if the position is the reference position, i.e., if a specific piston of the engine has reached top dead center. When it is judged that the reference position has not yet been reached due to the lack of input of a reference position signal, the routine returns to step 102, where the reading and judgement are repeated.

When it is judged at step 103 that the reference position has been reached, the routine proceeds to step 104, where the rotational angle signal is read from the sensor provided at the distributor. Then, at step 105, it is judged if the opening timing of the intake/exhaust valve 1 determined previously has been reached. When that timing has not yet been reached, the routine returns to step 104, where the reading and judgement are repeated.

When it is judged at step 105 that the opening timing has been reached, the routine proceeds to step 106, where the spill valve 26 is closed. Therefore, as mentioned earlier, if the distributor type oil pump 11 is in the compression stroke, the pressure of the pressure chamber 17 rises. At that time, high pressure hydraulic fluid is supplied to the one of the discharge ports 23 communicated with the discharge passage 22 of the plunger 14 and the hydraulic cylinder 9 of one intake/exhaust valve 1 by the high pressure passage communicated with the same and the intake/exhaust valve 1 opens.

To compute the amount of lift of the intake/exhaust valve 1, at step 107, the rotational angle is read and at step 108 the rotational angles since step 106 are added. The speed of opening of the intake/exhaust valve 1 due to the supply of hydraulic pressure is substantially constant and the cumulative value of the rotational angles of the engine corresponds to the amount of lift of the intake/exhaust valve 1, so it is possible to view the cumulative value of the rotational angles as the amount of lift. Further, at step 109, it is judged if the amount of lift of the intake/exhaust valve 1 is over the target value determined previously. If it is not over it, then the routine returns to step 107, where the reading and judgement are repeated.

When it is judged at step 109 that the amount of lift of the intake/exhaust valve 1 has reached the target value, the routine proceeds to step 110, where the spill valve 26 is opened. By this, the pressure in the pressure chamber 17 falls and the supply of pressurized oil to the hydraulic cylinder 9 is stopped, but the check valve 24 closes and does not discharge pressurized oil, so the intake/exhaust valve 1 continues in the open state while maintaining that amount of lift. Next, to detect the closing timing of the intake/exhaust valve 1, at step 111, the rotational angle signals output by the rotational angle sensor are read. Then, at step 112, it is judged from the magnitude of the rotational angle if the previously determined closing timing has been reached. If the closing timing has not yet been reached, the routine returns to step 111, where the reading and judgement are repeated.

When it is judged at step 112 that the closing timing has been reached, the routine proceeds to step 113, where the relief valve 33 is opened. The opening 29*a* of the relief channel 29 is formed sufficiently large and is set so that around that timing the opening 29*a* and a relief port 30 are communicated. Due to the opening of the relief valve 33, the high pressure hydraulic fluid of the high pressure passage and the hydraulic cylinder 9 is discharged into the low pressure chamber 20 and the intake/exhaust valve 1 is closed along with movement of the hydraulic piston 10. Further, at step 114 as well, the rotational angle is read and at step 115 it is judged if the timing has arrived for communicating a third relief port 35 with the opening 29*b* of the relief channel 29 of the plunger 14. The opening 29*b* gives a predetermined phase difference to the opening 29*a*, so the timing when the opening 29*b* communicates with a relief port 35 becomes after a predetermined rotational angle has been rotated through from the timing of communication of the opening 29*a* to the relief port 30. When that timing has not yet arrived, the routine returns to step 114, where the reading and the judgement are repeated.

When it is judged at step 115 that the timing for communication of a third relief port 35 and the opening 29*b* has arrived, there is no longer any need for the discharge of the hydraulic pressure by the relief valve 33, so the routine proceeds to step 116, where the relief valve 33 is closed, then the routine returns to step 100, where the control program of FIG. 3 is repeated.

Figure 4:
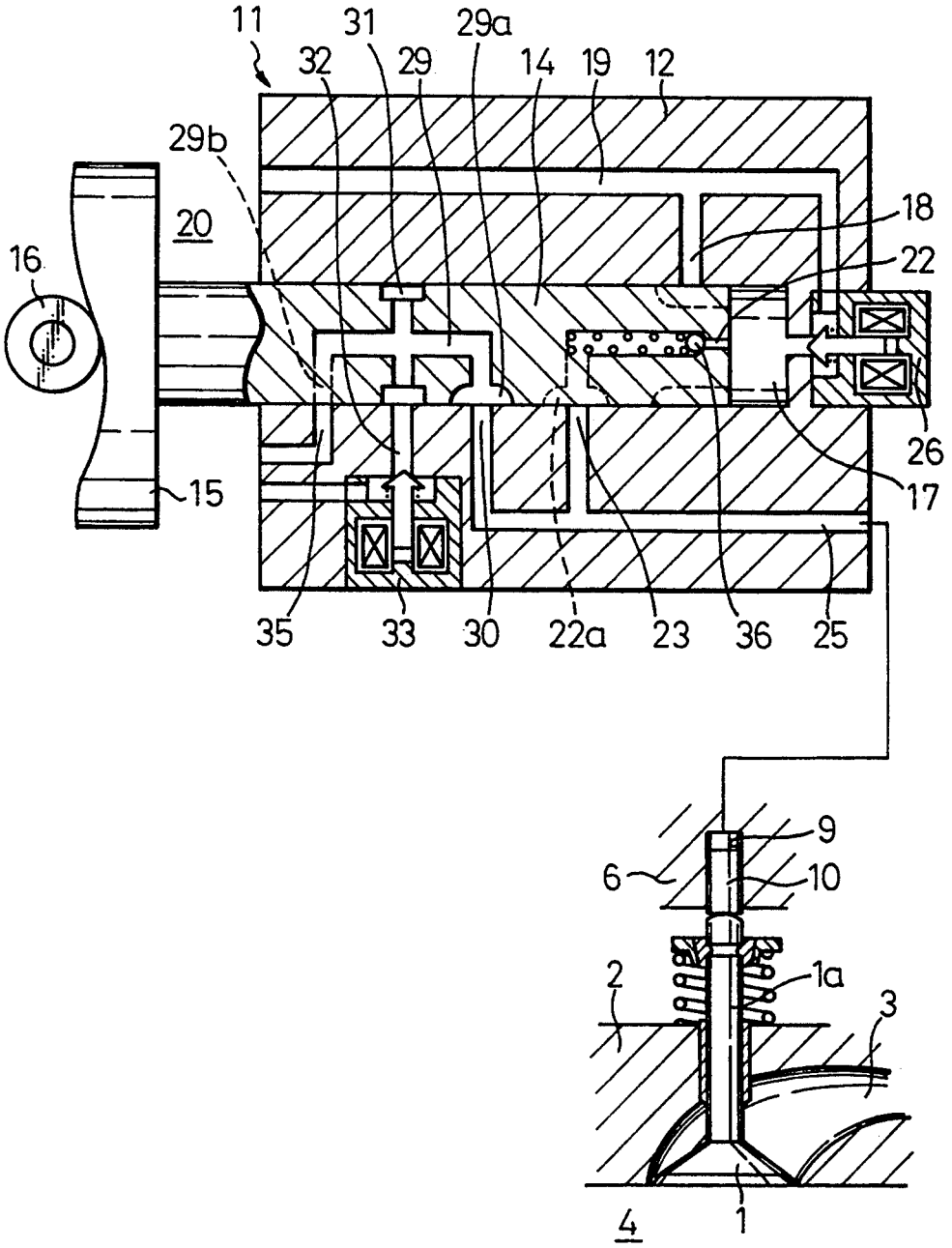
FIG. 4 is a sectional view of the overall configuration of a valve drive device according to a second embodiment of the present invention.

FIG. 4 shows the overall configuration of a valve drive device according to a second embodiment of the present invention. In the first embodiment shown in FIG. 1, the same number of check valves 24 as the intake/exhaust valves 1 being driven are provided in the cylinder block 12 of the distributor type oil pump 11, but in the second embodiment, instead of this, there is the difference that a single check valve 36 is provided in the plunger 14. The rest of the configuration is similar to that of the first embodiment. Even with a single check valve 36, the same type of action is performed as the check valves 24 of the first embodiment, so the second embodiment exhibits the same type of effects as the first embodiment. The construction becomes simpler, so this is advantageous in terms of the costs and the ease of manufacture compared with the first embodiment.

In the first embodiment shown in FIG. 1 and in the second embodiment shown in FIG. 4, by using the check valves 24 or 36, when the supply of pressurized oil to the hydraulic cylinder 9 stopped, it was possible for an intake/exhaust valve 1 to maintain its lift and continue in the open state, but the check valves 24 and 36 are not essentials and can be eliminated by adopting a construction taking their place.

Figure 7:
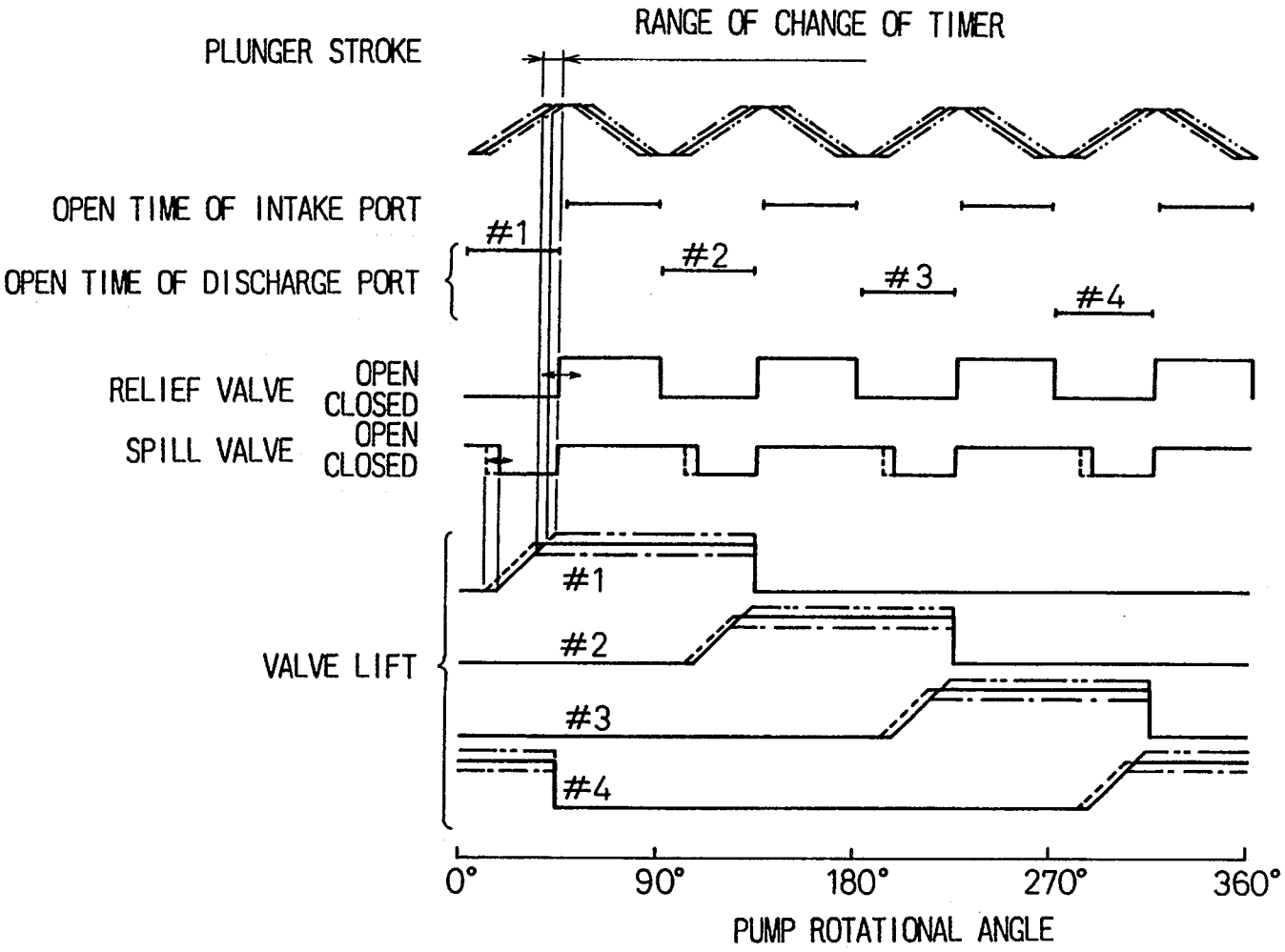
FIG. 7 is a time chart of the operation of the third embodiment.

An example where the configuration of the basic portions is substantially the same in the first embodiment and the second embodiment but no use is made of a check valve 24 or 36 is given as a third embodiment. In this third embodiment, the opening positions and diameters of the openings 22*a* of the intake grooves 21 and the discharge passage 22 in the plunger 14 and the opening positions and diameters of the intake port 18 and the discharge port 23 in the cylinder block 12 are suitably set and further the relationship between the face cam 15 and the cam roller 16 is adjusted. Then, as shown in FIG. 7, by setting things so that the opening 22*a* and the discharge ports 23 are communicated for exactly the duration of the compression stroke of the plunger 14 and the intake port 18 and the intake grooves 21 are communicated for exactly the time of the intake stroke of the plunger 14, in the valve drive device of the third embodiment, even without provision of the check valves 24 or check valve 36 in the distributor type oil pump, the substantially same operation and effect as the first embodiment and the second embodiment are obtained.

Even in the third embodiment, the routine for starting the opening operation of an intake/exhaust valve 1 is similar to the case of the first embodiment shown in FIG. 2. However, in the first embodiment, the end of the opening operation was determined by the opening of a spill valve 26 in accordance with a command from the ECU 27, but in the third embodiment, the check valves 24 or 36 are not used, so there is the difference that the opening operation of an intake/exhaust valve 1 is made to end by the end of the compression stroke of the plunger 14. In the intake stroke of the plunger 14, the discharge ports 23 are closed, so even without the check valves 24 or 36, the high pressure of the hydraulic fluid in the hydraulic cylinder 9 is maintained and the intake/exhaust valve 1 can continue in the open state.

In this way, in the third embodiment, in the same way as the first embodiment, it is possible to freely control the starting timing of the opening operation of an intake/exhaust valve 1 by changing the closing timing of the spill valve 26 by the ECU 27, but the timing of the end of the opening operation depends on the timing of the end of the compression stroke of the plunger 14, so it is not possible to freely change the timing of ending of the opening operation nor can the amount of lift of the intake/exhaust valve 1 be changed by a method other than changing the starting timing of the opening operation. Therefore, in the third embodiment, by moving the stationary position of the cam roller 16 in the rotational direction of the face cam 15 as with a timing adjustment mechanism well known for distributor type injection pumps used for diesel engines, it is possible to shift the phase of the stroke of the plunger 14 and freely control the timing of the end of the opening operation and the amount of lift of the intake/exhaust valve 1.

Figure 5:
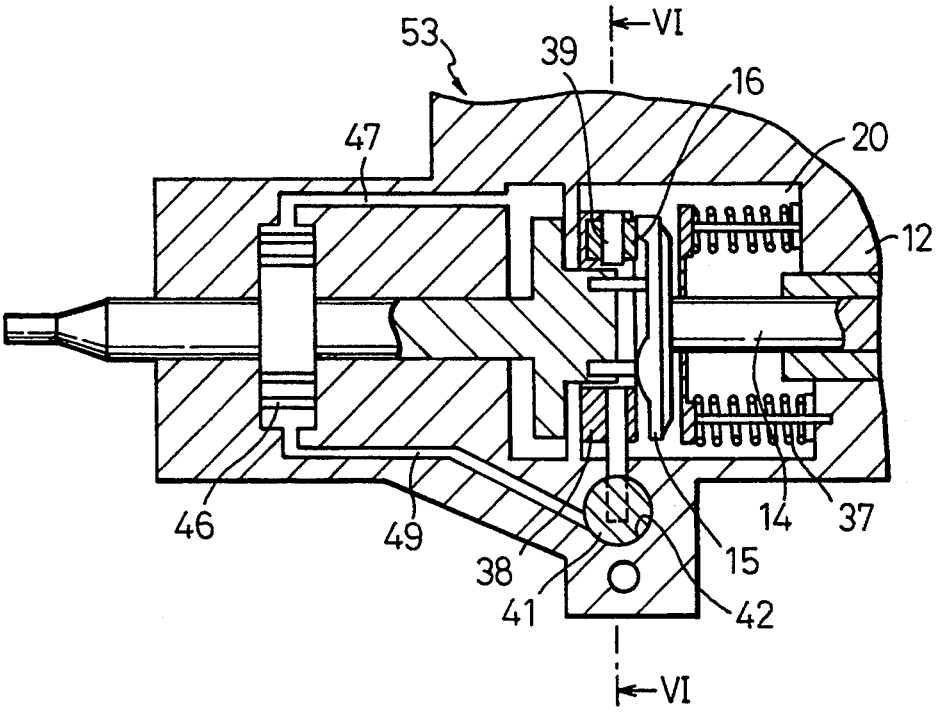
FIG. 5 is a sectional view of a timing adjustment mechanism of a key portion of a third embodiment.
Figure 6:
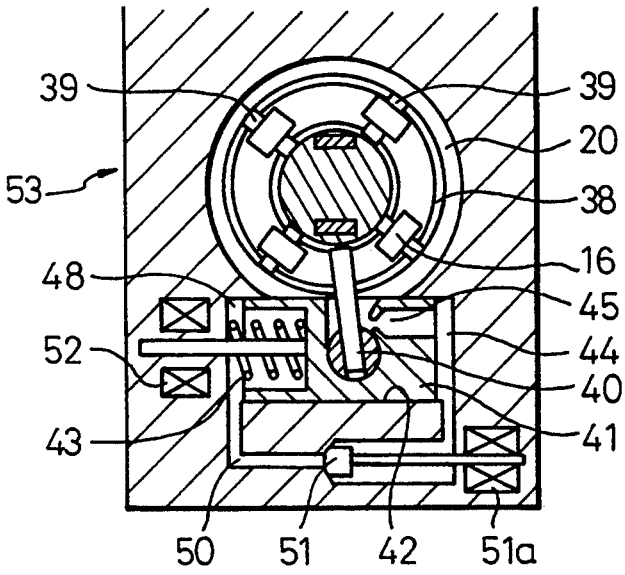
FIG. 6 is a sectional view along line VI—VI in the timing adjustment mechanism of FIG. 5.

The specific constructions of a timing adjustment mechanism used for a distributor type oil pump in the valve drive device of the third embodiment are illustrated in FIG. 5 and FIG. 6. While omitted in FIG. 1 and FIG. 4, the face cam 15 formed integrally with the plunger 14 is pushed against the cam roller 16 by the compression spring 37. A plurality (four) of cam rollers 16 are supportedly rotatably by a roller shaft 39 provided radially around a common roller ring 38. In this case, the roller ring 38 itself can be rotated to make adjustments at that position. By the engagement of the bottom end of a slide pin 40 provided in the roller ring 38 with the timer piston 41, it is adjusted in rotation.

The timer piston 41 is, as shown in FIG. 6, engaged slidably in a timer cylinder 42 formed in the direction orthogonal to the plunger 14 in the cylinder block 12 and is biased by a timer spring 43 in the right direction. The space 44 at the right side of the timer piston 41 communicates with the "low pressure side chamber" through a throttle portion 45, i.e., in this case, the low pressure chamber 20. The low pressure chamber 20 is supplied with and filled by hydraulic fluid pressurized to about several hundred kilopascals by the feed pump 46 through piping 47, so the space 44 is under pressure.

On the other hand, the space 48 at the left side of the timer piston 41 is communicated by the piping 49 with the intake side of the feed pump 46 and becomes substantially atmospheric pressure in the same way as the pressure of the hydraulic fluid tank, not shown.

The communicating piping 50 connecting the right side space 44 and the left side space of the timer piston 41 is provided with a timing control valve 51 able to be electrically controlled, such as a solenoid valve, able to open and close the same. Reference numeral **51*a* is a solenoid coil. The solenoid coil 51*a* is connected to the ECU 27 shown in FIG. 1 through a driver (drive circuit), not shown, and is energized intermittently by duty ratio control, whereby the timing control valve 51 is opened and closed. As a result, it is possible to make the pressure of the hydraulic fluid in the space 44 any magnitude between the pressure of the low pressure chamber 20 and atmospheric pressure, so the timer piston 41 moves to a position where that force balances with the force of the timer spring 43, the roller ring 38 is rotated through the slide pin 40, and the phase of the stroke of the plunger 14 can be changed. Note that a timer position sensor 52 is provided to detect the position of the timer piston 41**.

Since the valve drive device of the third embodiment is provided with a distributor type oil pump 53 of this construction, the ECU 27 can control the duty ratio of the timing control valve 51 to adjust the pressure of the space 44 and can make the timer piston 41 move against the timer spring 43 to turn the roller ring 38. The position of the moved timer piston 41 is detected by a timer position sensor 52 and that signal is fed back to the ECU 27. Since the timing of engagement of the cam roller 16 and the face cam 15 changes in this way, it is possible to change the timing of the compression and intake strokes of the plunger 14 and possible to freely control the timing of the end of the opening operation of an intake/exhaust valve 1 and the magnitude of the valve lift.

FIG. 7 shows the operation of the valve drive device of the third embodiment as a time chart in the same way as FIG. 2 showing the operation of the first embodiment. The point of difference from FIG. 2 is that the state shown by the broken line in FIG. 7 shows the case where the closing timing of the spill valve 26 is made earlier to make the timing of the start of opening of the intake/exhaust valve 1 earlier and the position of the cam roller 16 is adjusted to the rotational direction so as to make the timing of the end of the compression stroke of the plunger 14 earlier as well and make the timing of the end of the opening of the intake/exhaust valve 1 earlier so as to maintain a constant valve lift of the intake/exhaust valve 1 and make the timing of opening of the intake/exhaust valve 1 earlier as a whole. Further, the stroke of the plunger 14 can be changed to be earlier or later by the timing adjustment mechanism and as a result the lift of the intake/exhaust valve 1 can be changed.

Figure 8:
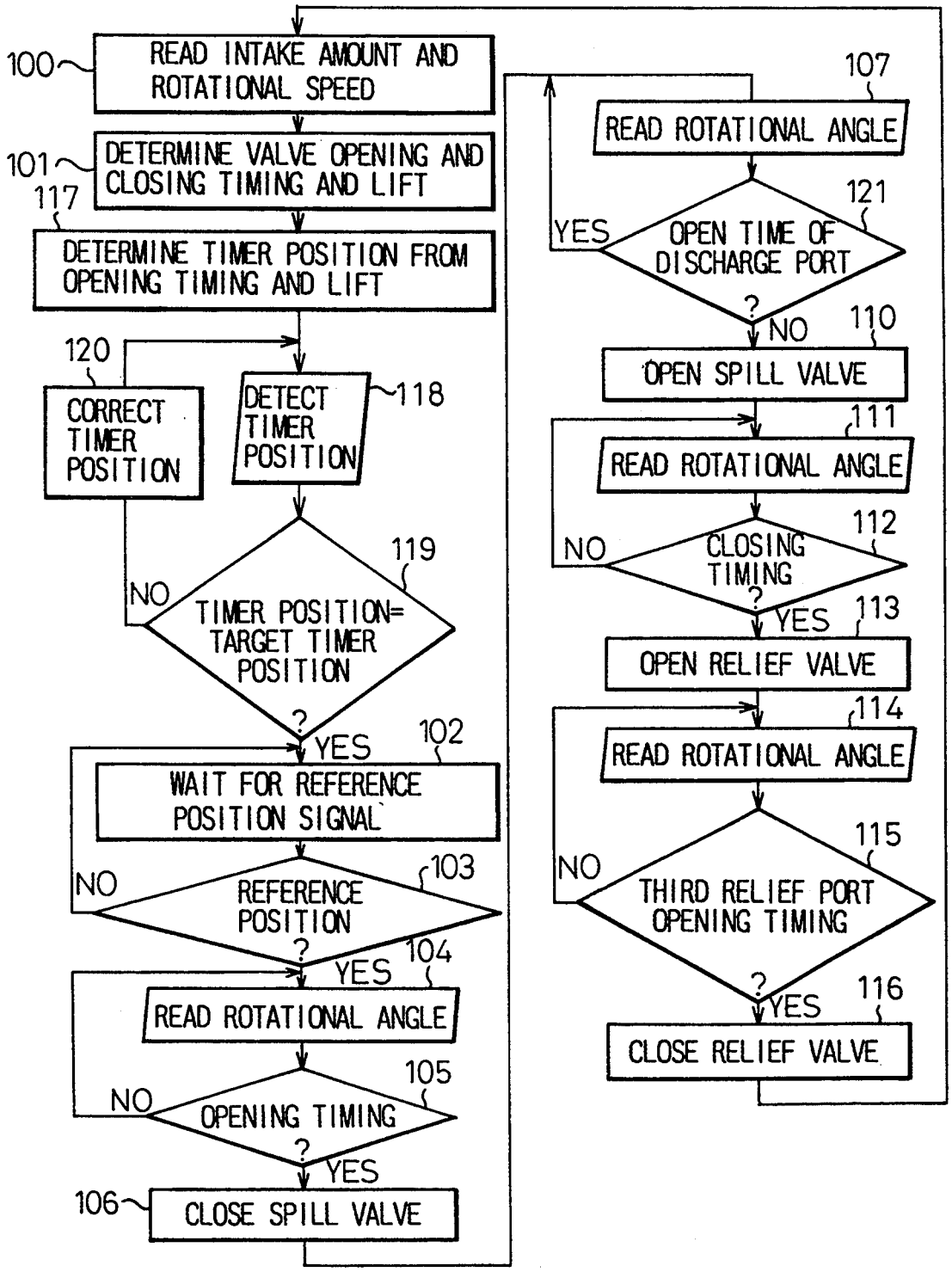
FIG. 8 is a flow chart of the control routine in the third embodiment.

The control program for the spill valve 26, the relief valve 33, and the timing adjustment mechanism in the third embodiment is illustrated in FIG. 8. The point of difference from the flow chart shown in FIG. 3 for the first embodiment is that after the opening timing and closing timing of the intake/exhaust valve 1 and the target value of the valve lift are determined at step 101, the target position of the timer piston 41 in the timing adjustment mechanism shown in FIG. 5 and FIG. 6 is determined from the opening timing and value of the valve lift at step 117. Then, at step 118, the signal of the timer position sensor 52 is read, and the routine proceeds to step 119, where it is judged if the target position determined at step 101 has been reached. When it has not been reached, at step 120, the duty ratio of intermittent energization of the solenoid coil **51*a* of the timing control valve 51 is changed and the pressure of the space 44 is changed to correct the position of the timer piston 41, then the routine returns to step 118**, where the reading and judgement are repeated.

When it is judged at step 119 that the position of the timer piston 41 has reached the target position, the routine proceeds to step 102, where the same processing as in FIG. 3 is performed.

Note that in the third embodiment, the opening operation of the intake/exhaust valve 1 can be continued continuously until the timing of the end of the compression stroke of the plunger 14, so the timing of the end of the opening operation is the same as the timing of the end of the time of continuation of the compression stroke, that is, the timing of the end of the time where a discharge port 23 is open (communicated with the opening **22*a* of the discharge passage 22). Therefore, at step 107, the rotational angle is read to detect the time elapsed after the closing of the spill valve 26 (that is, after the start of the opening operation of an intake/exhaust valve 1), then the routine proceeds to step 121, where it is judged if the time is still such where a discharge port 23 should be open. If it is judged that it is still that time, the routine returns to step 107, where reading and judgement are repeated. If the compression stroke of the plunger 14 ends and the communication between the opening 22a of the discharge passage 22 and a discharge port 23 is broken, then the judgement at step 121 becomes that it is not the time of opening of a discharge port 23, so in this case the routine proceeds to step 110, where the spill valve 267 is opened and the same processing is continued as in the case of the first embodiment shown in FIG. 3**.

The above embodiments were constructed with a single relief channel 29 and, for this, first relief ports 30, a second relief port 32 communicating with the relief valve 33, and third relief ports 35 directly opening to the low pressure chamber 20, but it is possible to provide two relief channels and divide these into separate systems.

Figure 9:
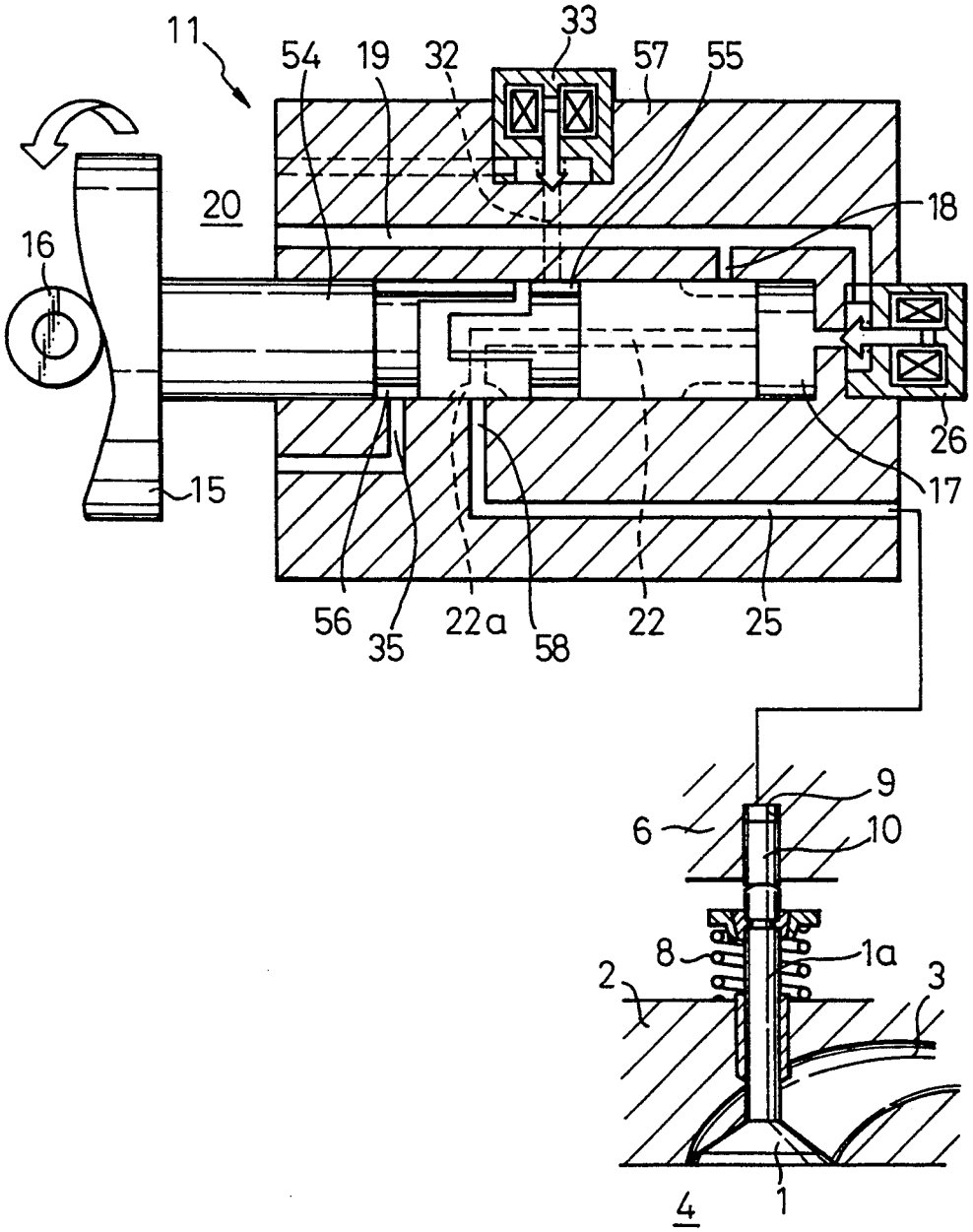
FIG. 9 is a sectional view of the overall configuration of a valve drive device according to a fourth embodiment.

The fourth embodiment shown in FIG. 9 is a realization of this idea. The plunger 54 of a distributor type oil pump 11 is provided with at least two relief channels, e.g., a first relief channel 55 of a groove shape formed in the cylindrical surface in the axial direction and a second relief channel 56 of a groove shape formed in parallel to this at a position of a different phase. In the cylinder block 57 is provided a valve operating port 58 serving as both a discharge port 23 and a first relief port 30 in the first embodiment (FIG. 1). In the same way as the first embodiment, provision is made of a second relief port 32 and the third relief ports 35, but the positions of the openings (phase) differ. The rest of the construction may be considered to be roughly the same as in the first embodiment.

Figure 10:
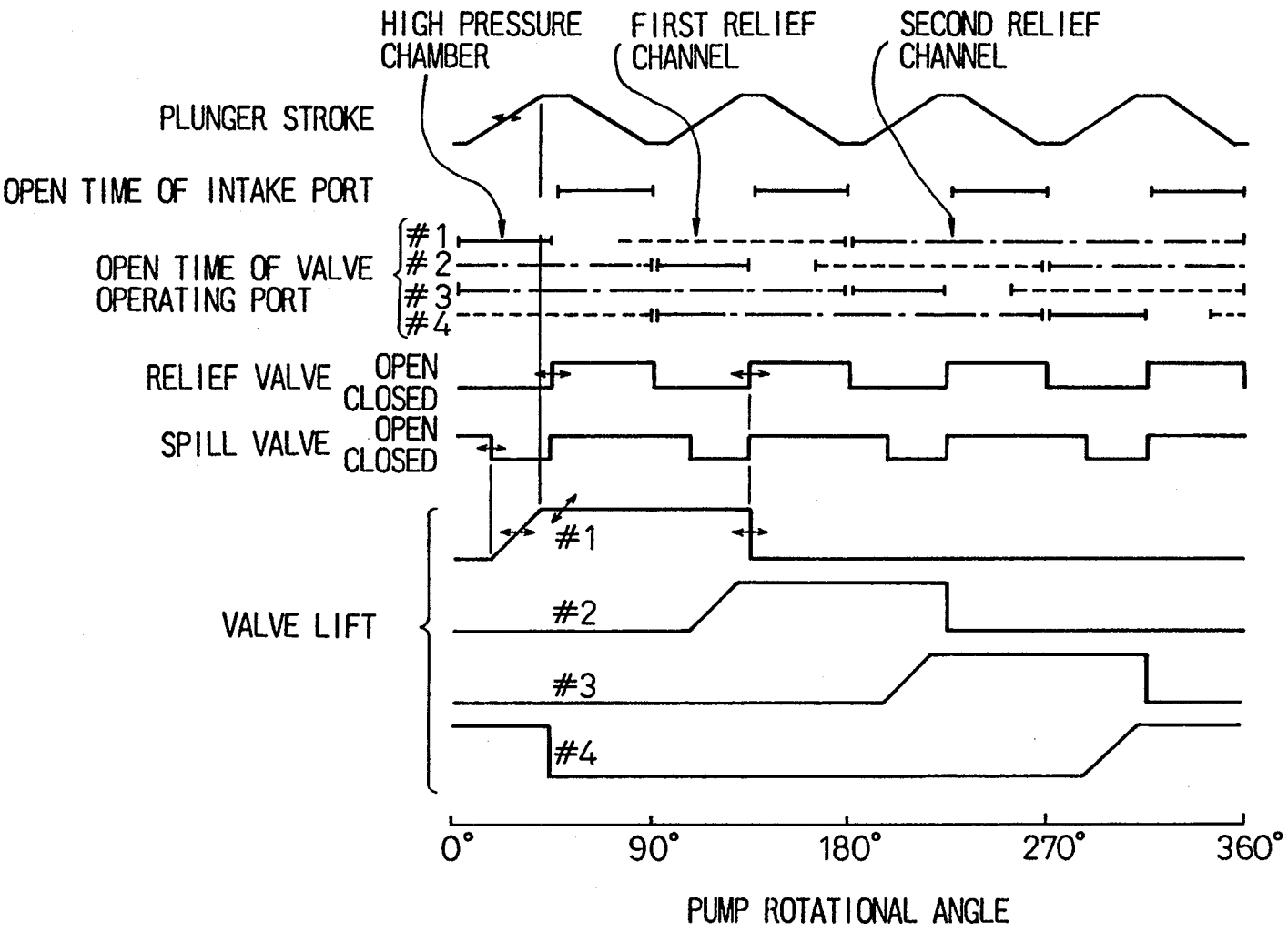
FIG. 10 is a time chart of the operation of the fourth embodiment.

The operation of the fourth embodiment is shown in the time chart of FIG. 10. First, by the operation of the plunger 54, the opening 22a of the discharge passage 22 comes into register with the valve operating port 58 and the pressure chamber 17 communicates with the high pressure passage 25. In that state, high pressure hydraulic fluid is supplied to the hydraulic cylinder 9 and the intake/exhaust valve 1 opens. Next, when the compression stroke of the plunger 54 ends, the communication between the opening 22a and the valve operating port 58 is simultaneously broken, so the high pressure hydraulic fluid is sealed in the hydraulic cylinder 9 and the high pressure passage 25 and the intake/exhaust valve 1 maintains its open state. After this, if the ECU 27 causes the relief valve 33 to open at any timing while the valve operating port 58 communicates with the first relief channel 55, the high pressure fluid of the high pressure passage 25 etc. is discharged from the second relief port 32 to the "low pressure side chamber", that is, in this case, the low pressure chamber 20, and the hydraulic pressure of the hydraulic cylinder 9 falls and the intake/exhaust valve 1 closes.

Further, if the valve operating port 58 communicates with the second relief channel 56, the hydraulic cylinder 9 communicates with the low pressure chamber 20 through a third relief port 35 and the residual pressure is completely eliminated. Even when the relief valve 33 breaks down and there is no discharge from the second relief port 32, the high pressure hydraulic fluid is discharged from a third relief port 35 directly after this, so the intake/exhaust valve 1 can close. Note that the control of the spill valve 26 and the setting of the timing of opening and closing of the various ports along with the motion of the plunger 54 are performed in the same way as the third embodiment not using a check valve.

The above embodiments were explained envisioning a case of actually driving just one of the intake valve or exhaust valve by the distributor type oil pump 11, though mention was made of an "intake/exhaust valve 1" of the engine, but it is also possible to consider driving all the intake valves and exhaust valves of a multicylinder engine by successively supplying high pressure hydraulic fluid by a single plunger of a distributor type oil pump by doubling the number of the ports and the number of relief channels of the distributor type oil pump 11. However, in the case of hydraulic drive, there are limits arising due to the viscosity of the hydraulic fluid, the limits of the rising speed of high pressure, etc., so there is a concern over unstable operation of the intake/exhaust valves 1 during high speed engine operation. Therefore, if the intake valves and exhaust valves with close opening timings are selected among the large number of intake/exhaust valves 1 of the multicylinder engine and these are combined to be driven and opened in the same compression stroke of the plunger, then it becomes possible to keep up sufficiently even during high speed operation and stable valve driving is performed.

For example, in a four-cylinder four-cycle engine, the intake valve which is number one in terms of the ignition order (hereinafter referred to as the number one valve, same below) and the number two exhaust valve, the number two intake valve and the number three exhaust valve, the number three intake valve and the number four exhaust valve, the number four intake valve and the number one exhaust valve are close in timings of opening and closing. In these combinations, however, usually the exhaust valves have opening timings slightly earlier than the intake valves. Therefore, if these sets of intake valves and exhaust valves are combined and made to open around the same time at the same compression stroke of a single plunger, then the problems mentioned above can be eliminated.

Figure 11:
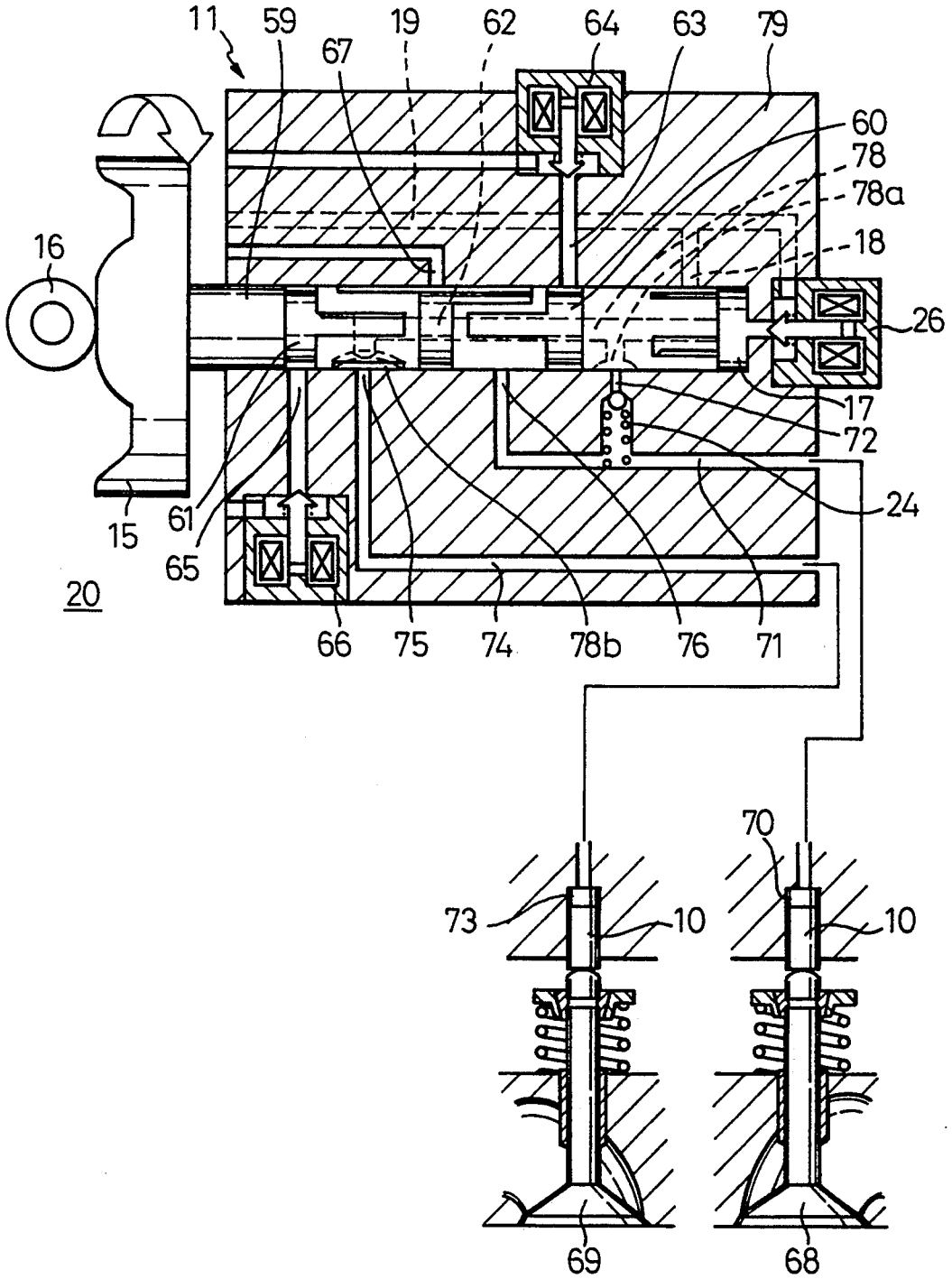
FIG. 11 is a sectional view of the overall configuration of a valve drive device according to a fifth embodiment.

The fifth embodiment shown in FIG. 11 realizes this idea. An exhaust valve relief channel 60, an intake valve relief channel 61, and a common relief channel 62, each of which is a groove-like passage on the columnar surface of the plunger 59 and has a planar section close to a T-shape when the surface is opened, are formed separated from each other in the axial direction. The exhaust valve relief channel 60 can communicate with the "low pressure side chamber" in which the low pressure hydraulic fluid is filled, in this case, the low pressure chamber 20, through the exhaust valve relief port 63 and the exhaust valve relief valve 64. Similarly, the intake valve relief channel 61 can communicate to the low pressure chamber 20 through the intake valve relief port 65 and intake valve relief valve 66, while the common relief channel 62 can do this through the common relief port 67.

The rest of the construction resembles that of the above embodiments, so the same reference numerals will be given to corresponding parts. However, in the fifth embodiment, all the exhaust valves, as represented by the number one exhaust valve 68, and all the intake valves, as represented by the number four intake valve 69, are driven by hydraulic pressure, so the exhaust valve hydraulic cylinder 70 for driving the exhaust valve 68 is communicated with the exhaust valve discharge port 72 through the exhaust valve high pressure passage 71 and the check valve 24 and the intake valve hydraulic cylinder 73 for driving the intake valve 69 is communicated with the intake valve operating port 75 at the end of the intake valve high pressure passage 74. Note that the exhaust valve high pressure passage 71 communicates with the exhaust valve relief port 76 as well without going through the check valve 24. Further, at the center of the plunger 59 is formed a discharge passage 78 extending from the pressure chamber 17, which discharge passage 78 is provided with an opening 78*a* for the exhaust valve discharge port 72 and an opening 78*b* for the intake valve operating port 75. Reference numeral 79 shows overall the cylinder block of the distributor type oil pump 11 in the fifth embodiment.

Figure 12:
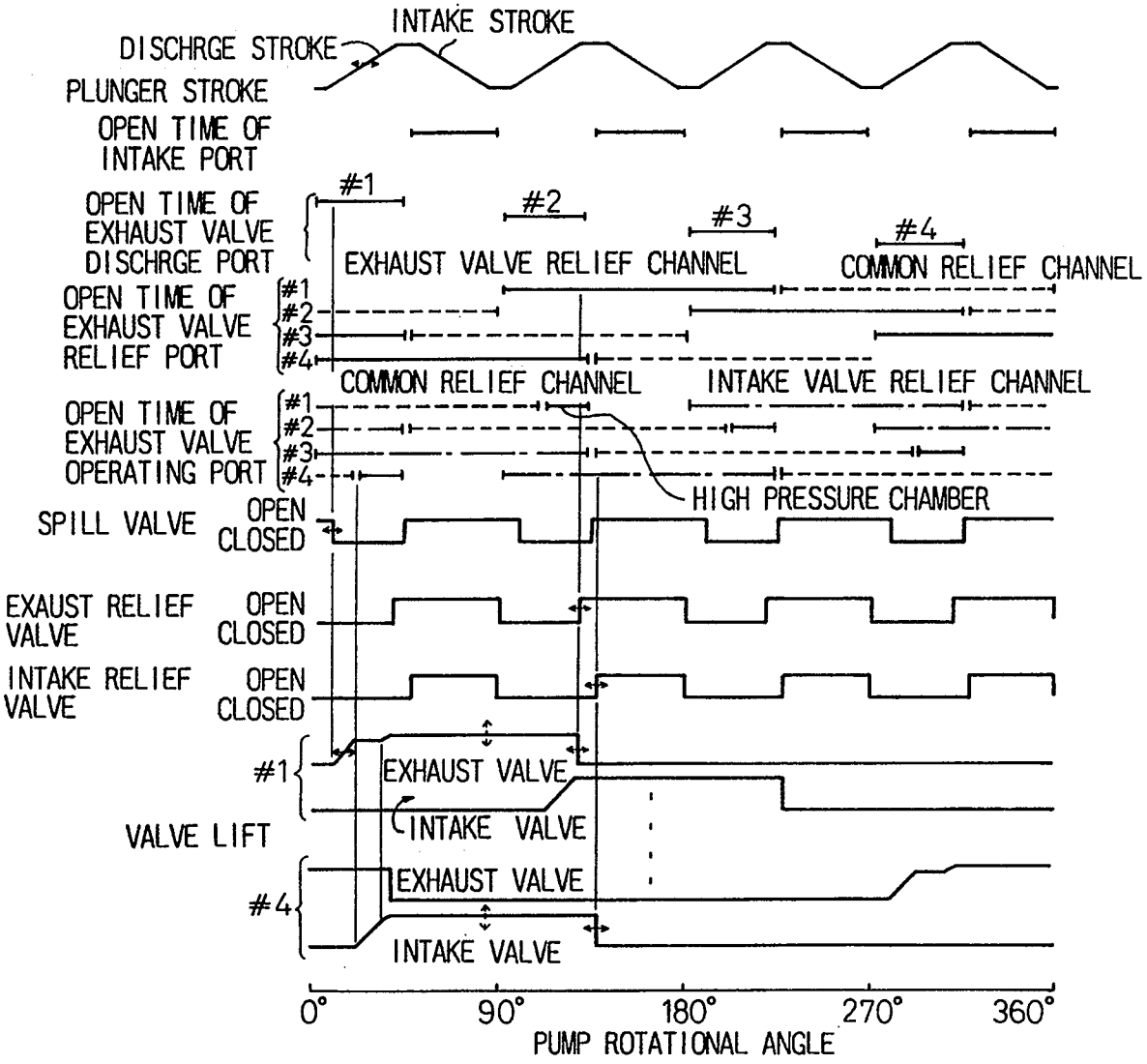
FIG. 12 is a time chart of the operation of the fifth embodiment.

The operation of the valve drive device of the fifth embodiment will be explained using as an example the set of the number one exhaust valve 68 and the number four intake valve 69. The order of operation is shown in the time chart of FIG. 12.

When the plunger 59 is in the middle of the compression stroke, if along with the rotation of the plunger 59 the pressure chamber 17 communicates with the exhaust valve discharge port 72 of the number one exhaust valve through the opening 78*a* of the discharge passage 78 and the spill valve 26 is closed by the ECU 27 (FIG. 1), the high pressure hydraulic fluid of the pressure chamber 17 pushes open the check valve 24 and is supplied from the exhaust valve high pressure passage 71 to the exhaust valve hydraulic cylinder 70 so as to press against the hydraulic piston 10 and open the number one exhaust valve 68.

Further, if just a little while after this the intake valve operating port 75 of the number four intake valve communicates with the opening 78*b* of the discharge passage 78, the high pressure hydraulic fluid of the pressure chamber 17 passes through the intake valve high pressure passage 74 to be supplied to the intake valve hydraulic cylinder 73 as well, so the number four intake valve 69 also starts to open. At this time, the pressure of the pressure chamber 17 falls, so the supply of the hydraulic fluid to the exhaust valve hydraulic cylinder 70 stops temporarily, the check valve 24 closes, and the number one exhaust valve 68 maintains its open state. Accordingly, the hydraulic fluid of the pressure chamber 17 solely is supplied to the intake valve hydraulic cylinder 73 and the intake valve 69 is made to open rapidly.

After this, when the pressure inside the intake valve hydraulic cylinder 73 becomes sufficiently high, the check valve 24 once again opens and the number one exhaust valve 68 and the number four intake valve 69 continue their opening operations simultaneously and end their opening operations when the plunger 59 completes its compression stroke. The exhaust valve discharge port 72 and the intake valve operating port 75 are both positioned in the cylinder block 79 so that communication between the opening 78*a* and 78*b* is broken before the plunger 59 enters its intake stroke and moves to the left in the figure, so if the ports 72 and 75 are cut off from each other, the exhaust valve 68 and intake valve 69 maintain their respective open states.

If after a predetermined opening time passes the ECU 26 opens the exhaust valve relief valve 64 in a state with the exhaust valve relief port 76 and the exhaust valve relief channel 60 communicated by the rotation of the plunger 59, the exhaust valve high pressure passage 71 communicates with the low pressure chamber 20 through the exhaust valve relief port 63, the pressure of the hydraulic fluid of the exhaust valve hydraulic cylinder 70 falls, and the number one exhaust valve 68 closes.

Further, if the intake valve relief valve 66 is made to open in a state when the intake valve operating port 75 and the intake valve relief channel 61 are communicated with each other, the pressure of the hydraulic fluid of the intake valve hydraulic cylinder 73 falls and the number four intake valve 69 also closes.

Even if the relief valves 64 and 66 break down or other problems occur and therefore the pressure of the hydraulic cylinder 70 or 73 does not drop, when the plunger 59 turns further and the exhaust valve relief valve 76 or the intake valve relief valve 75 communicate with the common relief channel 62, the pressures are discharged to the low pressure chamber 20 and the exhaust valve 68 or the intake valve 69 can close. The common relief channel 62 is formed on the plunger 59 for this purpose.

In the fifth embodiment, the timing of opening of the exhaust valve 68 can be freely changed by controlling the closing timing of the spill valve 26 by the ECU 27 or the timing of closing of the exhaust valves 68 and intake valves 69 can be freely changed by controlling the opening timing of the exhaust valve relief valve 64 and the intake valve relief valve 66, but it is not possible to directly control the opening timing of the intake valve 69. Note that with regard to the amount of lift of the valves, as explained in the third embodiment, by using a timing adjustment mechanism to control the phase of the stroke of the plunger 59, it is possible to simultaneously change the amount of lift of both of the exhaust valve 68 and the intake valve 69.

In the above embodiments, as the relief valve for controlling the closing timing of the intake/exhaust valves, use was made of an electrically controllable valve like a solenoid valve, but for controlling the closing of the intake valve, it is also possible to replace this valve with a simple throttle portion.

Figure 13:
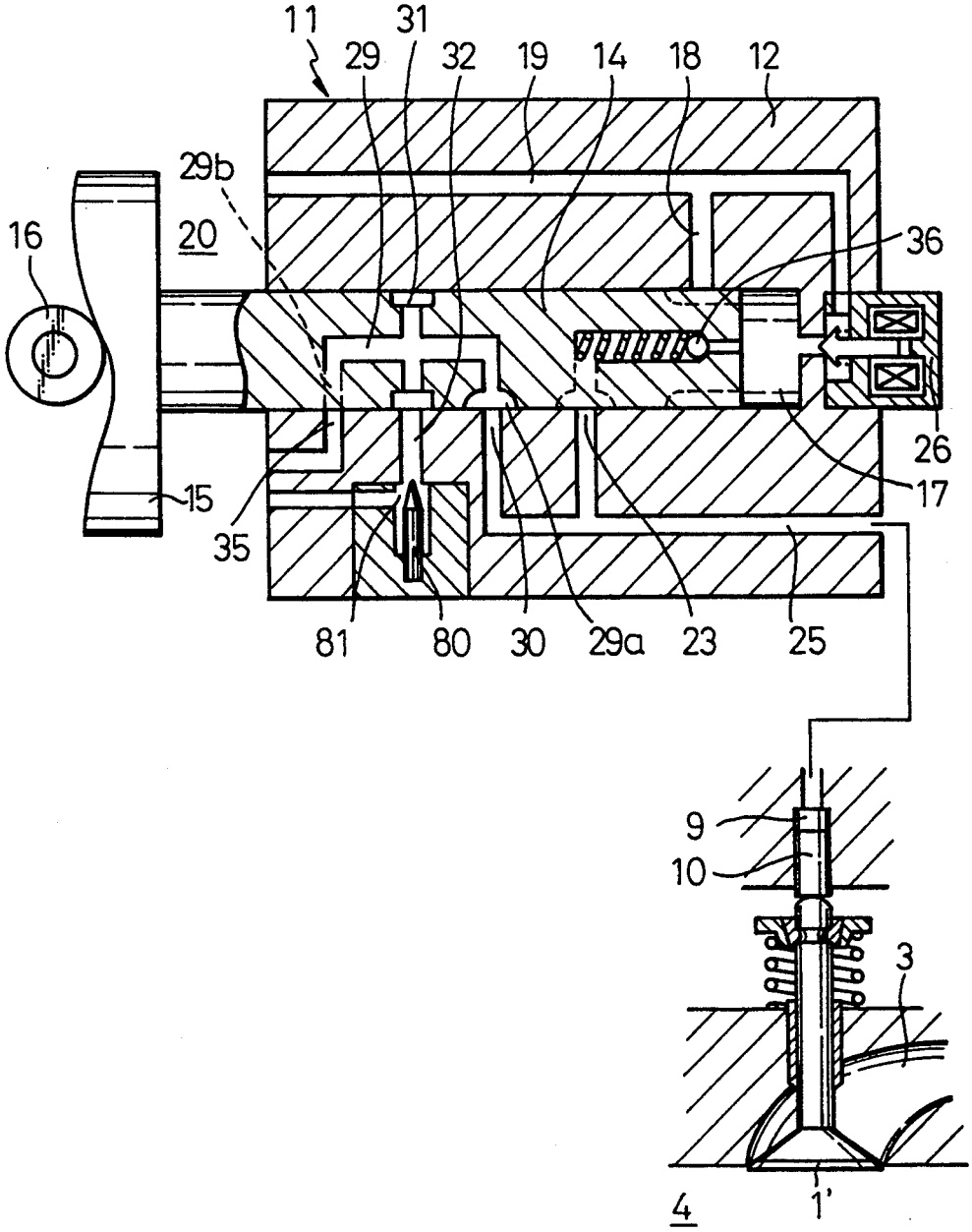
FIG. 13 is a sectional view of the overall configuration of a valve drive device according to a sixth embodiment.

In FIG. 13 showing the sixth embodiment, 80 shows a relief needle with a conical front end. This is inserted in place of the relief valve 33 in the first embodiment and the second embodiment into the second relief port 32 formed in the cylinder block 12 of the distributor type oil pump 11. By this, a relief throttle portion 81 is formed around the front end of the relief needle 80. As the material of the relief needle 80, a material sensitive to temperature changes, for example, stainless steel with a large heat expansion coefficient, is suitable. The rest of the construction is similar to the construction of FIG. 4 explained as a second embodiment, so the same reference numerals will be appended to the same portions and an explanation omitted.

In the operating state of the sixth embodiment, the way of maintaining the open and closed states of the intake valve 1' is similar to the case of the intake/exhaust valve 1 in the first embodiment and the second embodiment, so the explanation of valve opening will be omitted.

When the intake valve 1' reaches the closing timing and a first relief port 30 communicates with the opening 29*a* of the relief channel 29, the hydraulic fluid of the high pressure passage 25 passes through the relief throttle portion 81 of the second relief port 32 and is discharged to the "low pressure side chamber", in this case, the low pressure chamber 20, so the pressure of the hydraulic cylinder 9 falls and the intake valve 1' closes.

At this time, time for a certain amount of hydraulic fluid to be discharged is required from when a first relief port 30 communicates with the opening 29*a* of the relief channel 29 to when the intake valve 1' completely closes, but the relief needle 80 expands and contracts in accordance with the level of temperature so that at low temperatures when the viscosity of the hydraulic fluid is high it contracts to enlarge the relief throttle portion 81 and reduce the resistance of the flow of the hydraulic fluid while at high temperatures when the viscosity of the hydraulic fluid is low, it expands to reduce the relief throttle portion 81 and thereby increase the flow resistance of the hydraulic fluid. Therefore, even if the air temperature changes, the time for discharge of the hydraulic fluid becomes substantially constant.

Therefore, during a low speed rotation when one turn of the engine takes a long time, the closing timing of the intake valve 1' automatically becomes earlier and during high speed rotation when one turn takes a short time, the closing timing of the intake valve 1' automatically becomes later, so there is the effect that a high charging efficiency can be obtained over a wide range of rotational speeds. It goes without saying that this action occurs even in cases where the expansion or contraction of the relief needle 80 is insufficient and the time for discharge of the hydraulic fluid cannot be made approximately constant, so the effect of obtaining a high charging efficiency of the engine can be obtained to a certain extent. A relief needle 80 of stainless steel with a large heat expansion coefficient has the effect easing the effect of changes of viscosity of the hydraulic fluid due to temperature changes and guaranteeing the above operation.

Note that a temperature sensor like a thermocouple may be used to detect the temperature and the needle be moved electrically or a bimetal may be used to support the needle or other means employed to automatically adjust the size of the relief throttle portion 81.

Figure 14:
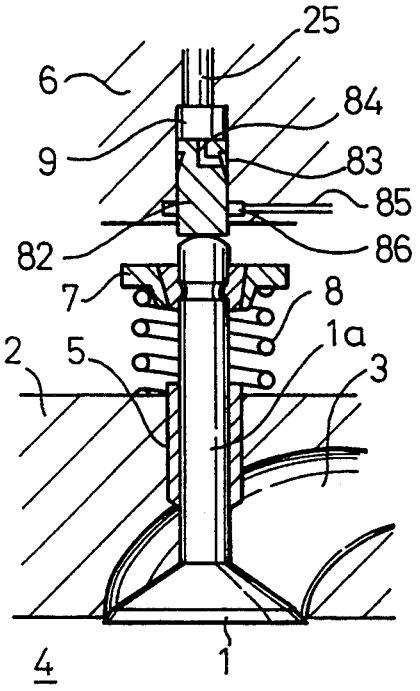
FIG. 14 is a sectional view of key portions according to a seventh embodiment.

FIG. 14 shows a seventh embodiment of the present invention, which embodiment is characterized in the point that provision is made of a means for preventing the opening operation of an intake/exhaust valve 1 by the hydraulic pressure from going too far and damaging the valve drive device. In this case, the hydraulic piston 82, which is inserted into the hydraulic cylinder 9 to drive an intake/exhaust valve 1 and presses the top end of the stem 1*a* of the intake/exhaust valve 1, is provided with a lift limit channel 83, that is, an annular groove, at its outer circumference. This communicates with the high pressure passage 25 to the hydraulic cylinder 9 through the passage 84. At part of the inner wall of the hydraulic cylinder 9 is opened a limit port 85 communicating with a "low pressure side chamber", that is, the low pressure chamber 20. To ensure reliable operation, the limit port 85 has connected to it an annular groove 86 formed at a position on the inner wall of the hydraulic cylinder 9 at the same height.

When the intake/exhaust valve 1 is made to open, like with the first embodiment, the high pressure hydraulic fluid is supplied through the high pressure passage 25 to the hydraulic cylinder 9 and the hydraulic piston 82 is pushed down, so the intake/exhaust valve 1 opens the port 3 to the combustion chamber 4 against the biasing force of the valve spring 8, but when the lift limit channel 83 of the hydraulic piston 82 communicates with the annular groove 86 and the limit port 85, the high pressure hydraulic fluid of the high pressure passage 25 passes through the limit port 85 and is discharged to the low pressure chamber 20 and the pressure of the hydraulic piston 9 falls, so the hydraulic piston 82 stops at that position. Therefore, it is possible to prevent the amount of lift of the intake/exhaust valve 1 from becoming excessively large and damaging the valve drive device.

Figure 15:
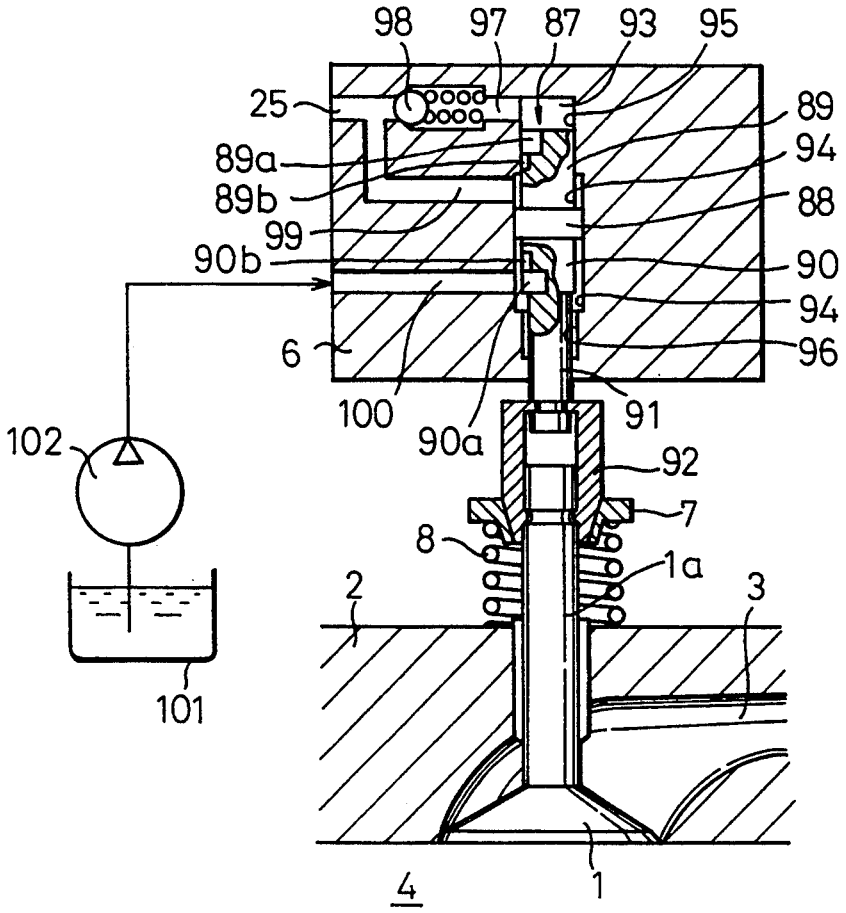
FIG. 15 is a sectional view of key portions according to an eighth embodiment.

FIG. 15 shows an eighth embodiment of the present invention, which is characterized by constructing a hydraulic brake at the two ends of the stroke of the hydraulic piston corresponding to the limits of opening and closing of the intake/exhaust valve 1 so as to enable trouble-free stopping of the hydraulic piston.

The hydraulic piston 87 has a shape comprised of numerous portions of different diameters stacked on each other integrally in the axial direction and is provided with at least a center 88 with the largest diameter, a top 89 and a bottom 90 with somewhat smaller diameters connected at its top and bottom, and a connection portion 91 having a diameter smaller than the bottom 90 and connecting to the same. The connection portion 91 is attached to the top end of the stem 1*a* of the intake/exhaust valve 1 through a valve holder 92. At the bottom end of the bottom 90 of the hydraulic piston 87 are formed a deep groove 90*a* and a shallow groove 90*b* connected to the same and closer to the center 88. Similarly, the top end of the top 89 of the hydraulic piston 87 has formed in it a deep groove 89*a* and a shallow groove 89*b* connected to the same and closer to the center 88.

Matching with the hydraulic piston 98 with its step shaped, the hydraulic cylinder 93 which receives the same is comprised of numerous portions with different diameters. That is, the hydraulic cylinder 93 is comprised of at least a center cylinder 94 with the largest diameter which receives the center 88 of the hydraulic piston 87 fluid-tightly and allows a predetermined distance of movement in the axial direction, a top cylinder 95 which can receive the top 89 of the hydraulic piston 87 fluid-tightly, and a bottom cylinder 96 which can receive the bottom 90 fluid-tightly.

Further, a first port 97 is opened in the top cylinder 95 and is connected to the high pressure passage 25 as shown in FIG. 1 through a check valve 98. Further, the high pressure passage 25 is opened to the top end of the center cylinder 94 directly by a second port 99. Further, a third port 100 is opened at the portion close to the bottom end of the center cylinder 94 so that the hydraulic fluid of the tank 101 is pressurized by the low pressure pump 102 and constantly fed to the bottom of the center 88 of the hydraulic piston 87 in the center cylinder 94. Note that while not shown, the low pressure pump 102 is provided with a relief valve for adjusting the discharge pressure to a certain level.

The key portions of the eighth embodiment are comprised in this way, so when the opening operation of the intake/exhaust valve 1 approaches its end, the bottom 90 of the hydraulic piston 87 enters into the bottom cylinder 96 and fits there. At this time, the hydraulic fluid which had been pressurized by the low pressure pump 102 and filled from the third port 100 to around the connection portion 91 inside the bottom cylinder 96 passes through the deep groove 90*a* and escapes to the third port 100, so the hydraulic piston 87 which moves downward encounters a relatively small resistance for the first time. When the hydraulic piston 87 descends further, the shallow groove 90*b* engages with the bottom cylinder 96 and the hydraulic fluid in the bottom cylinder 96 has no route of escape other than to pass through the shallow groove 90*b* with the small sectional area, so the hydraulic fluid remaining in the bottom cylinder 96 is compressed. Due to its counterforce, the movement of the hydraulic piston 98 encounters a large resistance, so the hydraulic piston 87 stops without trouble at the bottom movable limit, that is, a predetermined opening position of the intake/exhaust valve 1, and the intake/exhaust valve 1 can be prevented from opening too much.

A similar hydraulic braking action occurs also at the movable limit of the top of the hydraulic piston 98. That is, the hydraulic fluid which is supplied from the high pressure passage 25 through the first port 97 and the second port 99 to the hydraulic cylinder 93 accumulates in the top space of the hydraulic piston 87 in the top cylinder 95, but when the hydraulic piston 87 moves upward, the accumulated hydraulic fluid is compressed by the entry of the top 89 of the hydraulic piston 87 into the top cylinder 95. At this time, the check valve 98 closes, so the compressed hydraulic fluid first passes through the deep groove 89*a* and escapes to the second port 99, but when the hydraulic piston 87 enters further deeper into the top cylinder 95, the only escape route of the hydraulic fluid becomes the shallow groove 89*b* and the movement of the hydraulic piston 87 to the top comes under great resistance. When the shallow groove 89*b* enters into the top cylinder 95, compression becomes impossible and the hydraulic piston 87 stops at that position. The intake/exhaust valve 1 is set so as to be seated on the valve seat and be closed at that time. In this way, the intake/exhaust valve 1 is subjected to a hydraulic braking action at the end of both of the opening operation and the closing operation and therefore will easily stop and not overrun, so damage to the valve drive device can be prevented.

The above embodiments all had the high pressure hydraulic fluid in the hydraulic cylinder 9 be discharged as is to the low pressure chamber 20, one of the low pressure side chambers, when the intake/exhaust valve 1 was closing, so the energy of the pressure of the discharged hydraulic fluid was wastefully discarded. This poses the problem of energy loss. Accordingly, if the energy of the pressure of the hydraulic fluid discharged at the time of closing of the intake/exhaust valve 1 can be given to the hydraulic cylinder 9 of another intake/exhaust valve 1 opening at that time, then it would be possible to recover at least part of the discarded energy and reduce the energy loss.

For example, in a four-cylinder four-cycle engine, the time from when the intake/exhaust valve 1 of one cylinder begins to close to when it becomes fully closed overlaps the time from when the intake/exhaust valve 1 of the next cylinder to be ignited starts to open to when it becomes fully open. Therefore, it is possible to resolve this problem by making use of the high pressure hydraulic fluid which is discharged from when the intake/exhaust valve 1 of one cylinder starts to close to when it becomes fully closed so as to push the plunger 14 or 54 of the oil pump 11 which is operating in a direction of opening the intake/exhaust valve 1 of the next cylinder in the ignition order.

Figure 16:
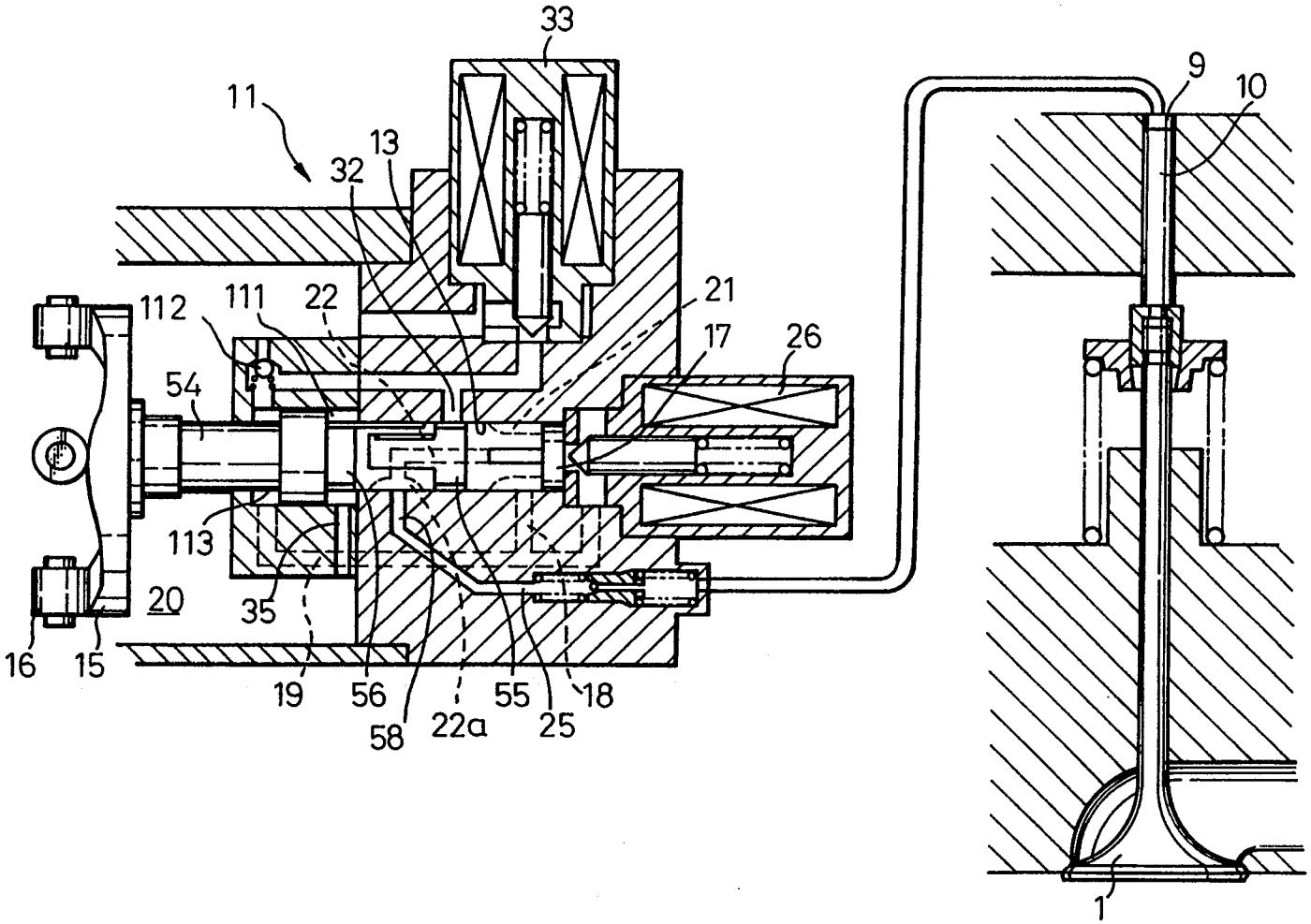
FIG. 16 is a sectional view of the overall configuration of a valve drive device according to a ninth embodiment.

The ninth embodiment shown in FIG. 16 shows one example for realization of this idea. The plunger 54 and the pump cylinder 13 for receiving the same are given steps in their shape. Between them are formed a new oil adjustment chamber 111 and a pressure recovery chamber 113 corresponding to the so-called "low pressure side chamber" in this embodiment. The oil adjustment chamber 111 is communicated with the second relief channel 56 of the shape shown in FIG. 9 (fourth embodiment) formed in the plunger 54 and is in constant communication with the pressure chamber 20 through a third relief port 35. The pressure recovery chamber 113 is communicated with the first relief channel 55 through the relief port 32 and communicates with the intake port 18 through the passage 19 and, in some cases, can communicate even with the low pressure chamber 20 through the check valve 112. The rest of the construction may be considered to be roughly the same as the above embodiments. In this way, it is necessary to note that in the ninth embodiment, before the so-called "low pressure side chamber" means the low pressure chamber 20, it means the pressure recovery chamber 113 with a higher pressure of the hydraulic fluid inside it.

Figure 17:
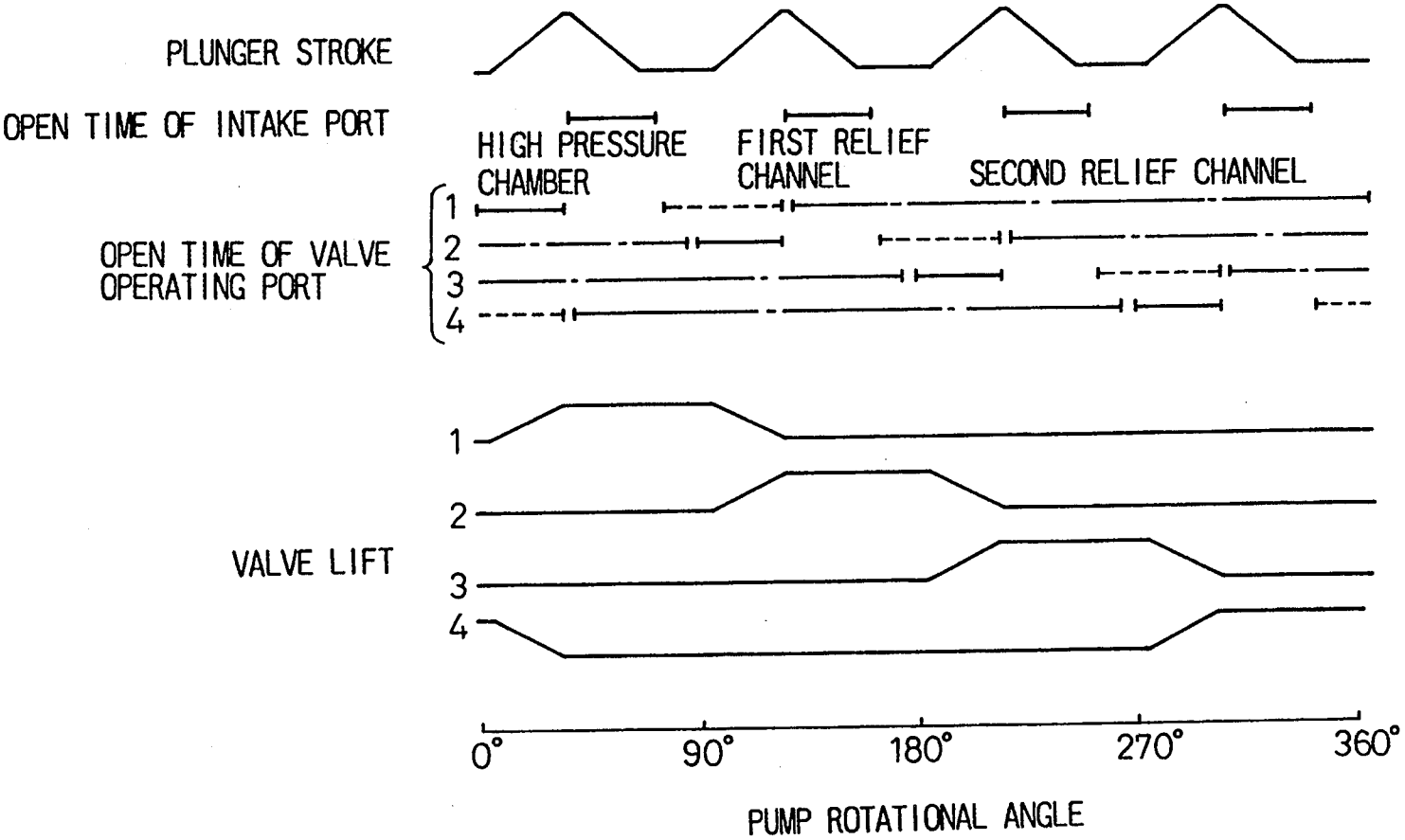
FIG. 17 is a time chart of the operation of the ninth embodiment.

FIG. 17 shows the operation of the ninth embodiment as a time chart. Here, for simplification of the explanation, the explanation will be made of the case where the spill valve 26 and the relief valve 33 are both continuously closed. First, in the state where the opening 22*a* of the discharge passage 22 is in register with the valve operating port 58 by motion of the plunger 54 and the pressure chamber 17 is communicated with the high pressure passage 25, the high pressure hydraulic fluid is supplied to the hydraulic cylinder 9 and the intake/exhaust valve 1 is opened. Next, when the compression stroke of the plunger 54 ends, the communication between the opening 22*a* and the valve operating port 58 is simultaneously broken, so the high pressure hydraulic fluid is sealed in the hydraulic pressure cylinder 9 and the high pressure passage 25 and the intake/exhaust valve 1 maintains its open state. After this, when the valve operating port 58 communicates with the first relief channel 55, the hydraulic cylinder 9 ends up communicating with the pressure recovery chamber 113 through the high pressure passage 25 and the first relief channel 55, but the high pressure hydraulic fluid is sealed in these passages and chambers, so the intake/exhaust valve 1 maintains its open state.

After this, when the plunger 54 enters its compression stroke for opening the intake/exhaust valve 1 of the next cylinder and moves to the right in FIG. 16, the volume of the pressure recovery chamber 113 formed at the left side of the plunger 54 increases, so the high pressure hydraulic fluid at the high pressure passage 25 etc. is taken into the pressure recovery chamber 113, the hydraulic pressure in the hydraulic pressure chamber 9 falls, and the previous intake/exhaust valve 1 closes. At this time, the high pressure hydraulic fluid taken into the pressure recovery chamber 113 at the left side of the plunger 54 ends up pressing the plunger 54 in the right direction and assisting the opening operation of the intake/exhaust valve 1 of the next cylinder, so the majority of the energy consumed for the pressurizing of the hydraulic fluid can be recovered by this. In addition to this, when the plunger 54 enters into its next intake stroke, the intake port 18 opens and the hydraulic fluid of the pressure recovery chamber 113 is taken into the pressure chamber 17, so it is possible to also reduce the consumption of energy for the intake.

Further, if the valve operating port 58 communicates with the second relief channel 56, the hydraulic cylinder 9 of the intake/exhaust valve 1 communicates with the low pressure chamber 20 through the oil adjustment chamber 111 and the third relief port 35 to completely eliminate the residual pressure. Also, by allowing the hydraulic fluid made excess by heat expansion etc. to escape to the low pressure chamber 20 or by supplementing from the low pressure chamber 20 the hydraulic fluid made in short supply due to leakage etc., the amount of the hydraulic fluid which is pressurized can be adjusted.

Note that the control of the spill valve 26 and the relief valve 33 and the setting of the timing of opening and closing of the various ports along with the motion of the plunger 54 are performed in the same way as the fourth embodiment (see FIG. 9 and FIG. 10) which does not recover the energy of the high pressure hydraulic fluid. However, the earlier the opening timing of the relief valve 33 is made and the earlier the closing timing of the intake/exhaust valve 1 is made, the less the amount of the energy of the high pressure hydraulic fluid which is recovered and the smaller the effect of reduction of the energy loss. This is unavoidable.

Even in the case of a six-cylinder internal combustion engine, it is possible to recover the energy of the high pressure hydraulic fluid as in the ninth embodiment. In this case, the time from when the intake/exhaust valve 1 of one of the cylinders starts to close to when it becomes fully closed corresponds to the time when the intake/exhaust valve 1 of the next cylinder becomes fully open and the plunger starts its intake stroke for the operation of the intake/exhaust valve 1 of the next cylinder. Therefore, if the device is constructed so as to use the hydraulic fluid discharged from the hydraulic cylinder 9 from when the intake/exhaust valve 1 of one cylinder starts to close to when it becomes fully closed so as to push the plunger in the direction of the next intake operation of the plunger, then the same effect would be obtained as with a four-cylinder internal combustion engine as with the six-cylinder engine.

Figure 18:
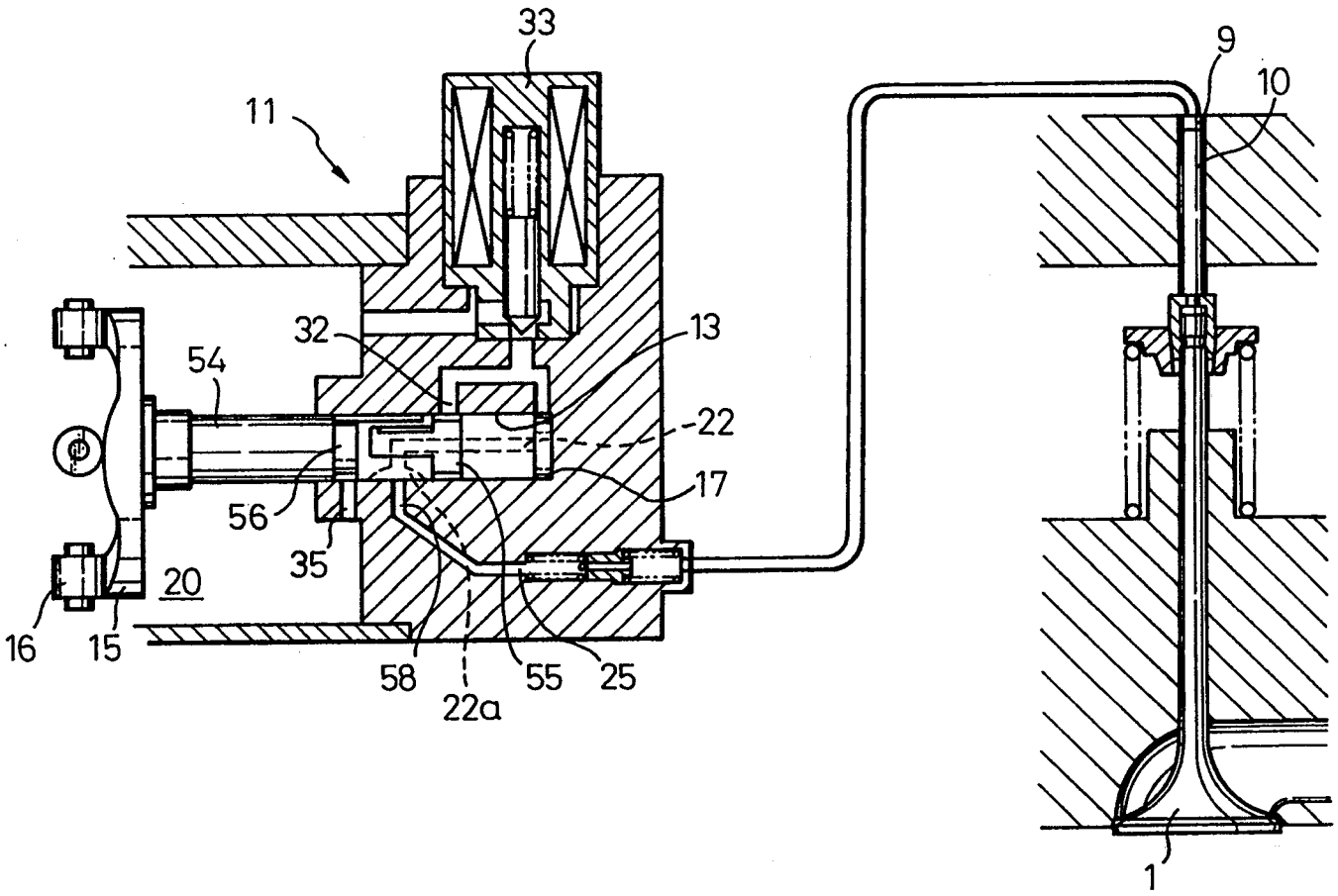
FIG. 18 is a sectional view of the overall configuration of a valve drive device according to a 10th embodiment.

The 10th embodiment shown in FIG. 18 realizes this idea. The relief port 32 is communicated with the pressure chamber 17 which can serve as the so-called "low pressure side chamber" in this embodiment at a predetermined timing. Further, parts corresponding to the intake port 18, the passage 19, the in-take groove 21, and the spill valve 26 in the ninth embodiment (FIG. 16) are eliminated in this case. The rest of the construction may be considered roughly the same as the above embodiments.

Figure 19:
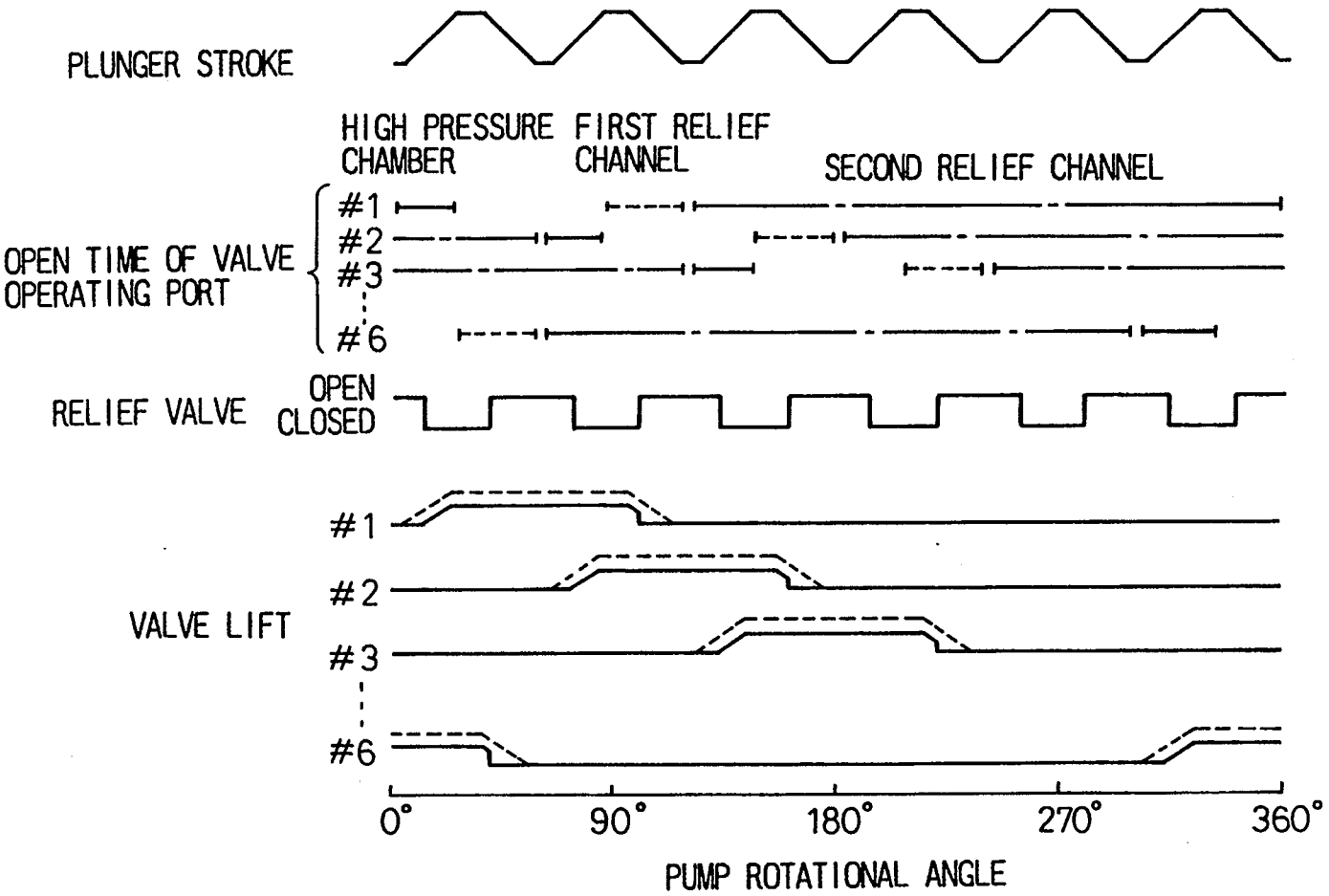
FIG. 19 is a time chart of the operation of the 10th embodiment.

The operation of the 10th embodiment is shown in the time chart of FIG. 19. If the relief valve 33 closes in the state where the opening 22*a* of the discharge passage 22 is in register with the valve operating port 58 and the pressure chamber 17 is communicated with the high pressure passage 25, the high pressure hydraulic fluid is supplied to the hydraulic cylinder 9 and the intake/exhaust valve 1 opens. Next, when the compression stroke of the plunger 54 ends, simultaneously the communication between the opening 22*a* and the valve operating port 58 is broken, so the high pressure hydraulic fluid is sealed in the hydraulic cylinder 9 and the high pressure passage 25 and the intake/exhaust valve 1 maintains its open state. After this, when the valve operating port 58 communicates with the first relief channel 55 and the plunger 54 enters its intake stroke, the high pressure hydraulic fluid of the high pressure passage 25 etc. is taken in from the relief port 32 to the pressure chamber 17, the hydraulic pressure of the hydraulic cylinder 9 of the intake/exhaust valve 1 falls, and the intake/exhaust valve 1 closes. That is, when the intake/exhaust valve 1 closes, the high pressure hydraulic fluid discharged from the hydraulic cylinder 9 and the high pressure passage 25 assists the intake operation of the plunge 54, so the energy consumed for the intake is reduced, which amounts to the same thing as recovery of energy.

Note that during the closing operation of the intake/exhaust valve 1, if the relief valve 33 opens due to the ECU 27 (see FIG. 1), the high pressure hydraulic fluid of the high pressure passage 25 etc. immediately is discharged to the low pressure chamber 20, so the hydraulic pressure of the hydraulic cylinder 9 of the intake/exhaust valve 1 falls and the closing operation is completed.

To obtain a sufficient effect of energy recovery in the ninth embodiment and the 10th embodiment, it is necessary to synchronize the closing timing of the intake/exhaust valve 1 and the compression stroke or intake stroke of the plunger 54. Therefore, the degree of freedom of design of the timing of the strokes of the plunger 54 becomes smaller. The earlier the closing timing of the intake/exhaust valve 1 is made by the relief valve 33, the smaller the effect of energy recovery. Therefore, if the hydraulic fluid discharged at the time of closing is stored as is at its high pressure and be made use of as a supplementary power source for the operation of the plunger 54, then it would be possible to recover the energy without regard to the timing among the intake/exhaust valve 1 and the plunger 54.

Figure 20:
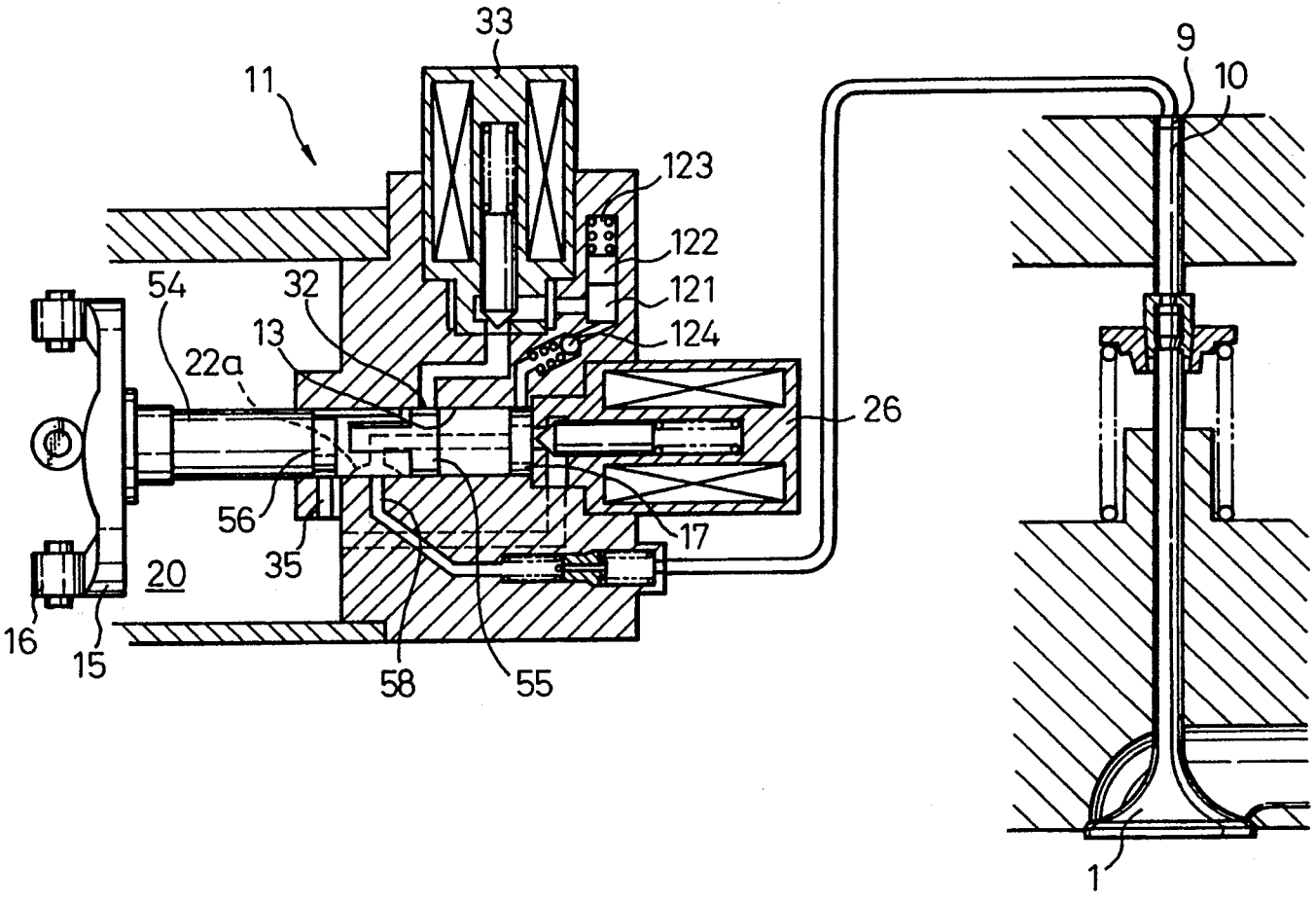
FIG. 20 is a sectional view of the overall configuration of a valve drive device according to an 11th embodiment.

The 11th embodiment shown in FIG. 20 realizes this idea. The outlet of the relief valve 33 communicates not with the low pressure chamber 20, but with the newly provided accumulator 121 as the "low pressure side chamber" in this case. The accumulator 121 is a cylindrically shaped hole formed in the housing of the oil pump 11 and has inserted slidingly inside it a columnar accumulator piston 122. This is biased by an accumulator spring 123 in a direction reducing the volume of the accumulator 121. In this case, the strength of the accumulator spring 123 is set so that the pressure inside the accumulator 121 at the time an amount of hydraulic fluid of one stroke of the intake/exhaust valve 1 flows into the accumulator 121 becomes lower than the pressure of the hydraulic fluid in the hydraulic cylinder 9 necessary for opening the intake/exhaust valve 1. Further, the accumulator 121 is made able to communicate with the pressure chamber 17 through a check valve 124. The rest of the construction may be considered to be roughly the same as in the above embodiments.

Next, an explanation will be made of the operation of the 11th embodiment. The holding of the open state and closed state of the intake/exhaust valve 1 is similar to the case of the fourth embodiment (see FIG. 9 and FIG. 10) in particular among the above-mentioned embodiments.

If the ECU 27 opens the relief valve 33 at any timing in the time when the valve operating port 58 communicates with the first relief channel 55, since the pressure inside the accumulator 121 is lower than that in the hydraulic cylinder 9, the high pressure hydraulic fluid of the high pressure passage 25 etc. flows from the relief port 32 into the accumulator 121, whereby the hydraulic pressure inside the hydraulic cylinder 9 falls and the intake/exhaust valve 1 closes. The hydraulic fluid stored in the accumulator 121 in this way pushes open the check valve 124 in the intake stroke of the plunger 54 and flows into the pressure chamber 17, then pushes the plunger 54 in the left direction in the figure to assist the intake operation of the pump, so that amount of energy is absorbed. The control of the spill valve 26 and the setting of the timings of opening and closing the ports along with the motion of the plunger 54 are performed in a similar fashion as with the previously mentioned embodiments.

We claim:

1. A valve drive device provided with:

a plunger which is driven to rotate with respect to a longitudinal axis of the plunger by an internal combustion engine and moves reciprocatingly in the axial direction of rotation as well, a cylinder which is formed in a cylinder block and receives the plunger fluid-tightly, at least one low pressure side chamber which can store hydraulic fluid in it, a pressure chamber which is formed in the cylinder block at the end of the plunger, takes in and pressurizes the hydraulic fluid of the low pressure side chamber, a discharge passage which is formed in the plunger and communicates with the pressure chamber and has at least one opening at the columnar surface of the plunger, a discharge port which is formed in the cylinder block so as to receive the hydraulic fluid pressurized in the pressure chamber when in register with the opening of the discharge passage by the rotational drive of the plunger, a valve driving hydraulic cylinder which is connected to the discharge port through a high pressure passage, a hydraulic piston which is inserted fluid-tightly in the hydraulic cylinder and generates a force for opening at least one of an intake and an exhaust valve of the internal combustion engine when receiving pressurized hydraulic fluid from the high pressure passage, at least one relief channel which is formed in the plunger and is able to communicate the high pressure passage to the low pressure side chamber by having at least one opening in the columnar surface of the plunger so as to discharge the pressurized hydraulic fluid in the high pressure passage to the low pressure side chamber and closes at least one of the intake and the exhaust valve, at least one relief port which is formed in the cylinder block and opens to a position able to communicate with the opening of the relief channel by rotational motion of the plunger, and a pressure reduction mechanism which is inserted between at least one relief port and the low pressure side chamber and controls the timing of closing of at least one of the intake and the exhaust valve.

2. A valve drive device according to claim 1, wherein said pressure reduction mechanism is provided with a relief valve.

3. A valve drive device according to claim 1, which is further provided with a low pressure passage able to communicate said pressure chamber and said low pressure side chamber and a spill valve which is inserted in said low pressure passage and controls the timing of opening of at least one of the intake and the exhaust valve.

4. A valve drive device according to claim 1, which is further provided with at least one check valve inserted in the passage of pressurized hydraulic fluid from said discharge passage formed in said plunger to said high pressure passage formed in said cylinder block.

5. A valve drive device according to claim 1, which is further provided with a separate relief port which is formed in said cylinder block and forcibly closes at least one of the intake and the exhaust valve by communicating with said low pressure side chamber at all times and opening at a position able to communicate with said relief channel by rotational motion of said plunger.

6. A valve drive device according to claim 1, which is further provided with:

a face cam which rotates integrally with said plunger so as to cause reciprocating motion of said plunger in the axial direction, a wave-like cam face which is formed on said face cam, a cam roller which engages with said cam face, a cam roller support mechanism which supports said cam roller, and a timing adjustment mechanism which is able to control the timing of the end of the opening operation of at least one of the intake and the exhaust valve by turning said cam roller support mechanism on the axis of said plunger to change the phase of the cam roller with respect to said cam face.

7. A valve drive device according to claim 1, which is further provided with at least two systems of relief channels separated from each other in the axial direction of said plunger.

8. A valve drive device according to claim 1, which is further provided with:

a separate opening, apart from the opening of said discharge passage formed in said plunger, provided in said discharge passage in the columnar surface of said plunger at a different position in the axial direction so as to cause both of the intake valve and exhaust valve of said internal combustion engine to open in a single compression stroke of said plunger, a separate discharge port formed in said cylinder block so as to receive hydraulic fluid pressurized in said pressure chamber when in register with said separate opening of said discharge passage due to rotational motion of said plunger, a separate hydraulic cylinder for valve driving which is connected through a separate high pressure passage to said separate discharge port, and a hydraulic piston which is inserted into said separate hydraulic cylinder in a fluid-tight manner and generates a force for opening a separate at least one of an intake and an exhaust valve of said internal combustion engine when receiving pressurized hydraulic fluid through said separate high pressure passage.

9. A valve drive device according to claim 1, wherein said pressure reduction mechanism is further provided with a throttle portion of the passage of the hydraulic fluid.

10. A valve drive device according to claim 1, wherein to prevent excessive opening of at least one of the intake and the exhaust valve, said valve driving hydraulic cylinder receiving said hydraulic piston is further provided with a limit port which communicates with said low pressure side chamber at a predetermined lift or more of the said hydraulic piston.

11. A valve drive device according to claim 1, wherein said hydraulic piston and said valve driving hydraulic cylinder which receives the same are provided with a hydraulic braking mechanism which brakes the hydraulic piston at an end period of an opening operation and a closing operation of at least one of the intake and the exhaust valve.

12. A valve drive device according to claim 1, wherein to enable the pressure of the hydraulic fluid in the low pressure side chamber to press against the end of the said plunger and assist its movement, said low pressure side chamber is formed connected to said end of said plunger and further provision is made of a passage which guides to the low pressure side chamber at the time of closing of at least one of the intake and the exhaust valve the high pressure hydraulic fluid supplied through the passage to the hydraulic cylinder of at least one of the intake and the exhaust valve at the time of opening of at least one of the intake and the exhaust valve.

* * * * *